United States Patent [19]

Hirasuna et al.

[11] Patent Number: 4,573,537

[45] Date of Patent: Mar. 4, 1986

[54] CASING PACKER

[75] Inventors: Alan R. Hirasuna, Newport Beach; Gordon R. Veal, Mission Viejo, both of Calif.

[73] Assignee: L'Garde, Inc., Newport Beach, Calif.

[21] Appl. No.: 644,495

[22] Filed: Aug. 24, 1984

Related U.S. Application Data

[63] Continuation-in-part of Ser. No. 261,468, May 7, 1981, abandoned.

[51] Int. Cl.[4] ..... E21B 33/128

[52] U.S. Cl. ..... 166/387; 166/134; 166/138; 166/140; 166/217; 277/116.2; 277/116.4; 277/144; 277/236

[58] Field of Search ..... 166/382, 387, 134, 138, 166/139, 140, 182, 216, 217; 277/5-7, 30, 31, 114, 117-119, 116.2, 116.4, 102, 120, 144, 190, 236

[56] References Cited

U.S. PATENT DOCUMENTS

| | | | |
|---|---|---|---|
| 823,760 | 6/1906 | Callanan | 277/236 |
| 1,043,723 | 11/1912 | Randolph | 277/9.5 |
| 1,651,131 | 11/1927 | Joyce | 277/236 |
| 1,683,640 | 9/1928 | Weise | 277/114 |
| 2,026,883 | 1/1936 | Gillespie | 277/116.4 |
| 2,464,713 | 3/1949 | Penick | 166/138 |
| 2,582,700 | 1/1952 | Jones | 277/166 |
| 2,642,141 | 6/1953 | Kolb | 277/9.5 |
| 2,970,651 | 2/1961 | Roberts | 166/212 |
| 3,363,695 | 1/1968 | McGill | 166/120 |
| 3,976,133 | 8/1976 | Allen | 166/120 |
| 4,138,126 | 2/1979 | Jaudt | 277/191 |
| 4,161,319 | 7/1979 | Stocking | 277/116.6 |
| 4,296,806 | 10/1981 | Taylor et al. | 166/120 |

OTHER PUBLICATIONS

Eight (8) pages of materials that were distributed Aug. 7th and 8th, 1979 at DOE sponsored meeting at Sandia Laboratories in New Mexico by the Foster-Miller Company.

*Primary Examiner*—Stephen J. Novosad
*Assistant Examiner*—Hoang C. Dang
*Attorney, Agent, or Firm*—Knobbe, Martens, Olson & Bear

[57] ABSTRACT

A well casing packer includes a seal mechanism, mounted on a mandrel. The casing packer comprises a seal element and a wedge member for driving the seal element radially outward against a well casing by applying radial forces to the seal element. This wedge member and a support member support the seal element to maintain the radial forces on the seal element, and the support member and the wedge member are constrained to move together during the driving of the seal element against the well casing. The casing packer also includes a mechanism for releasing the radial forces on the seal element, which comprises a member for releasing the constraint between the wedge and support members to allow these members to be longitudinally driven relative to one another to remove the support on the seal element by the wedge member, and thereby release the radial forces on the seal.

59 Claims, 20 Drawing Figures

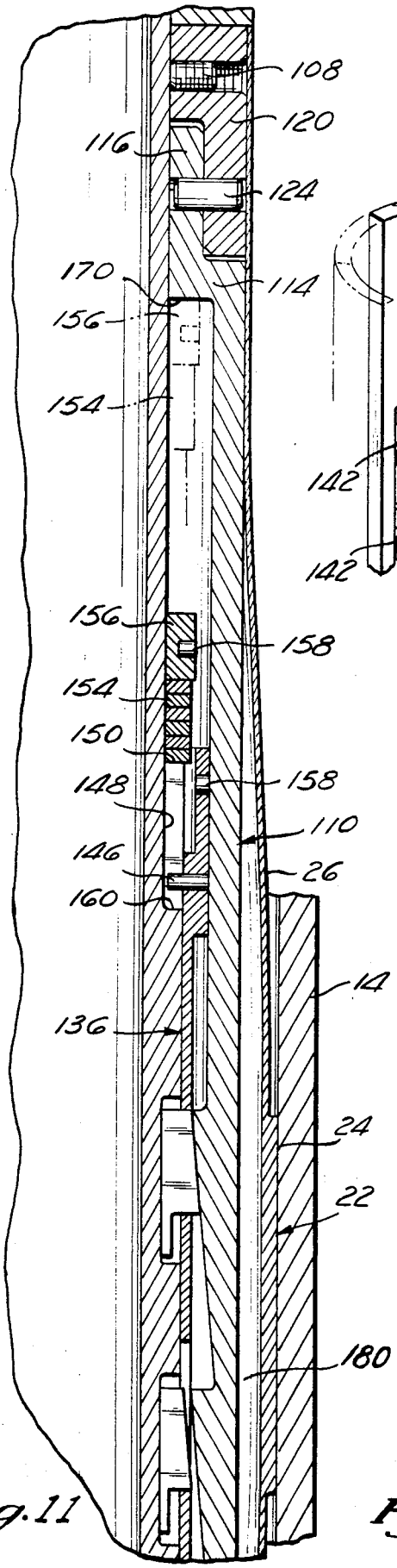
Fig. 11
Fig. 7
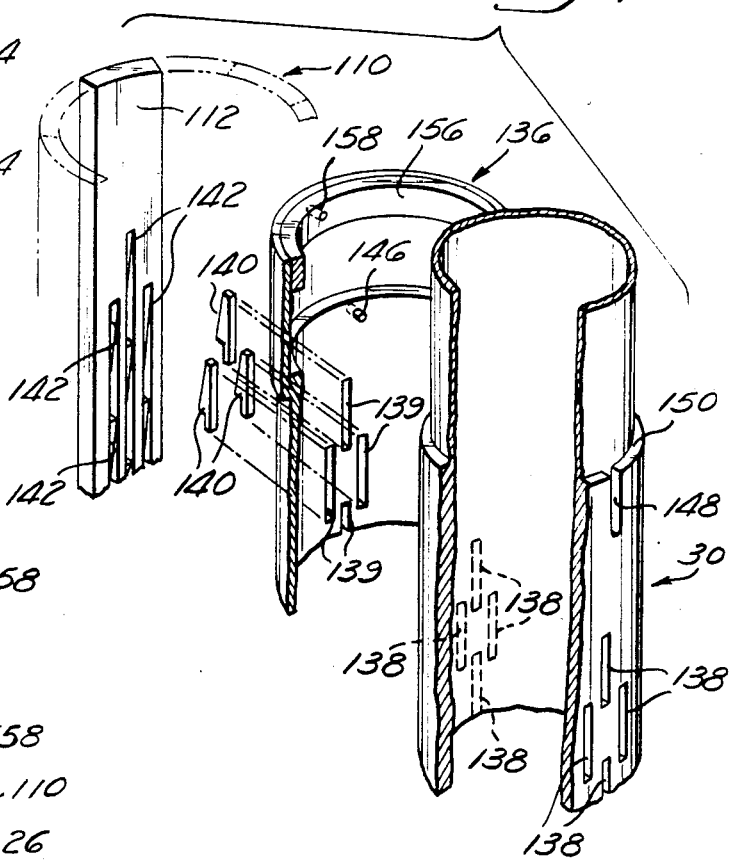
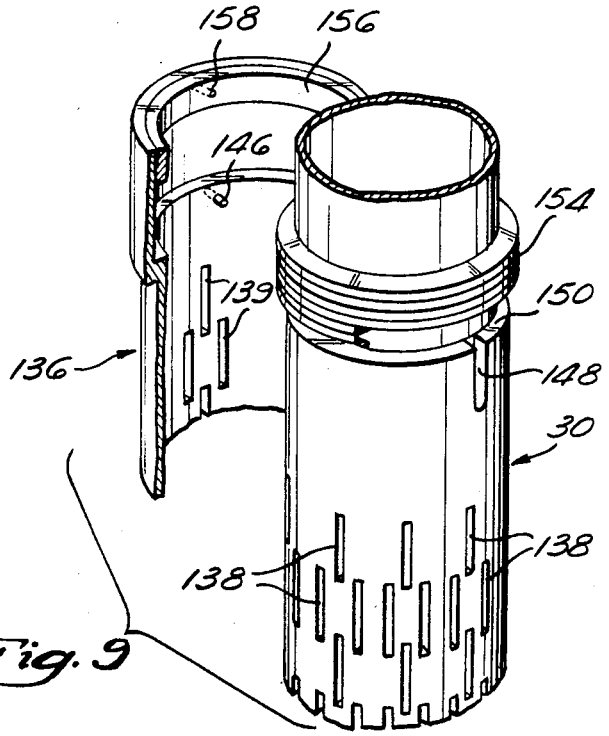
Fig. 9

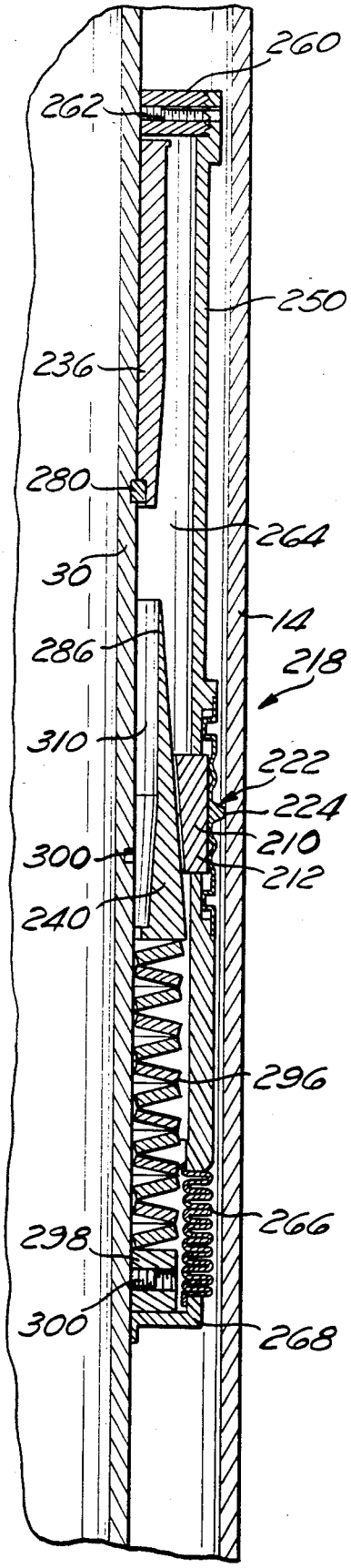
Fig. 17
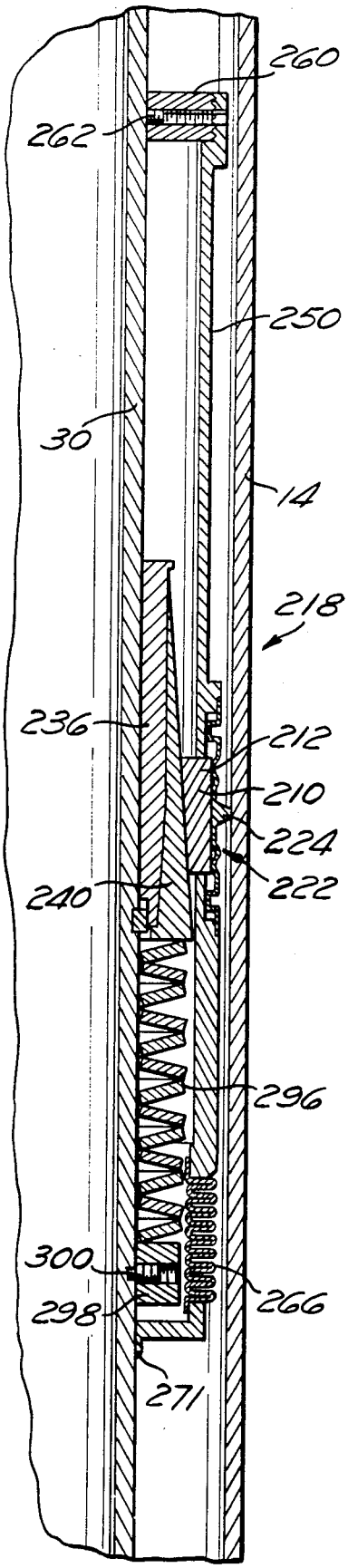
Fig. 16
Fig. 13
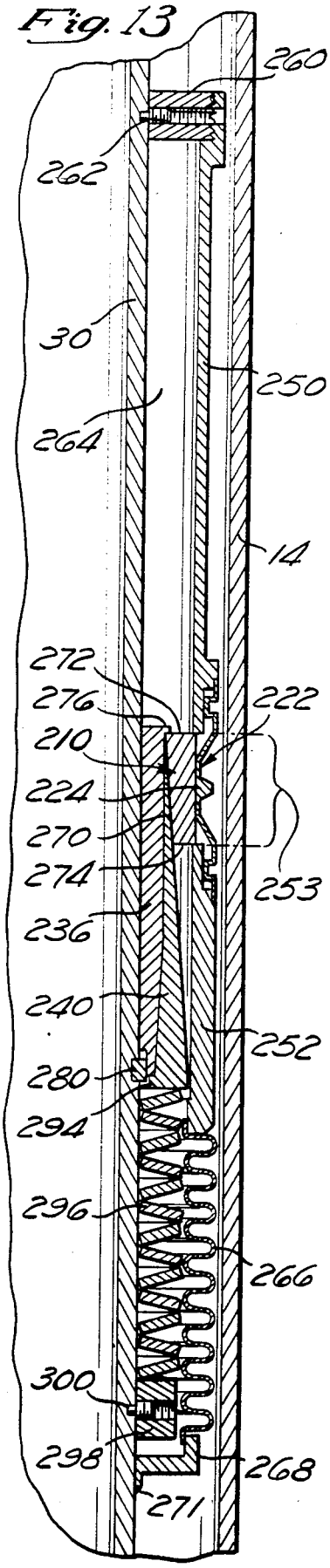

CASING PACKER

BACKGROUND OF THE INVENTION

This application is a continuation-in-part of copending U.S. patent application Ser. No. 261,468, filed May 7, 1981, abandoned, which is incorporated herein by reference.

The present invention relates generally to well casing packers and particularly to oil and gas well casing packers which seal the annulus between the well casing and a tube extending therein by direct application of radial force to the seal.

Casing packers are commonly used for thermal enhanced oil recovery (EOR) of heavy oil. Because heavy oil has a high viscosity, it typically becomes trapped in geologic formations, and therefore, cannot flow. Thus, heavy oil has proven extremely difficult to recover. One of the most promising techniques for enhancing the recovery of heavy oil involves injecting high temperature steam into the well at very high pressures. The high pressure, high temperature steam forms a condensation front at the oil front, and thereby heats the oil therein to decrease its viscosity. This permits the heavy oil to flow to adjacent wells where it can be withdrawn by conventional pumping methods.

In order to minimize heat loss in the annulus, casing packers are used to seal the annulus between the casing and steam injection tube or string. Since these casing packers are in direct communication with the injected steam, they must be capable of withstanding extremely high temperatures and pressures.

The two types of casing packers most commonly used are the compression packer and the inflatable packer. The seal element of a compression packer comprises a thick, compressible ring, typically rubber, supported by the packer's back-up rings which are mounted to the packer body which, in turn, is mounted on the steam injection tube. This seal ring is axially compressed between the back-up rings, thereby causing it to expand radially outward to seal the annular area between the injection tube and the casing. Such compression force creates high internal stresses in the seal element. In addition to the internal stresses created by the compression force, the seal element is also subjected to stress resulting from the extremely high pressure steam present in the lower portion of the well, beneath the seal. Such pressure is applied directly against the bottom of the seal, and thus, tends to force the elastomeric seal element upward, against the upper back-ring. This creates highly concentrated, internal stresses in the portion of the seal adjacent to the outer edge of the upper back-up ring. At high temperatures, such as those common with thermal EOR, these internal stresses commonly exceed the strength of rubber seal elements and, therefore, cause the seal to fail. Thus, compression packers have proven to have limited capability for higher temperature thermal EOR operations.

The inflatable packer typically comprises an inner rubber bladder overlaid with reinforcing members, and an outer rubber sealing element, all of which are bonded or vulcanized together. Fluid is forced into the bladder under pressure, which causes the bladder to expand and thereby force the rubber sealing element against the casing. Such pressure creates internal stresses in the rubber bladder. Further, as with the rubber ring of the compression packer, the rubber seal element of the inflatable packer also develops internal stresses due to the steam pressure in the lower portion of the well. At high temperatures, these internal stresses tend to cause the seal element to fail. Moreover, these high temperatures may also cause the bond between the reinforcing members and the rubber sealing element to fail. Thus, inflatable packers have also proven to have limited capability for thermal EOR operations.

A further problem with inflatable packers is that the fluid used to actuate the packer will be heated by the injected steam, and therefore, it is subject to thermal expansion. Water, for example, when compared to its volume at room temperature, will expand by about 25 percent at 500 degrees Fahrenheit and about 50 percent at 600 degrees Fahrenheit. Thus, the packer fluid pressure must be regulated continually to compensate for such thermal expansion.

As previously indicated, since both types of packers typically employ rubber seals, both are subject to failure as the operation time/service/temperature capability of rubber is exceeded. Depending on the application, the environment, the elastomeric polymer, and the specific compound or recipe used, the maximum temperature capability of elastomeric seals may range from 300 degrees to 575 degrees Fahrenheit. In contrast, thermal EOR may require the seal to withstand temperatures of more than 700 degrees Fahrenheit.

A further disadvantage of prior art casing packers is that when the seal setting forces are relaxed to release the seal, and a pull-up force is applied to remove the packer from the casing, these devices frequently jam. Such jamming may occur, for example, if the seal element engages irregularities or protrusions on the casing wall. This causes the seal element to be forced against the packer's lower back-up ring, and thereby causes the seal element to expand, further increasing the jamming. Typically, increasing the pull-up force on the packer does not free the packer since such pull-up force increases the pressure of the lower back-up ring on the seal element, and increases the jamming even further. Thus, it is often difficult to remove these prior art packers from the well casing.

Studies sponsored by the U.S. Department of Energy show that by 1995, over 50 percent of U.S. oil produced will be through thermal EOR techniques. This represents tapping only about 5 percent of the estimated reserves of heavy oil. The remaining 95 percent will be available as technology meets the challenge. For example, use of steam injection EOR techniques are theoretically possible at well depths of up to at least 6,000 to 7,000 feet. However, because the pressures required for thermal EOR normally increase in proportion to the well depth, it is usually not practical to use prior art casing packers at depths greater than 2,000 to 2,500 feet. Beyond this depth, the elastomeric seals tend to fail. Thus, as accessible resources are depleted, the need for application of thermal EOR techniques in the 2,000 to 7,000 foot range becomes increasingly essential.

SUMMARY OF THE INVENTION

The well casing packer of the present invention comprises a seal mechanism, which includes a seal element, and a wedge member for driving the seal element radially outward against a well casing by direct application of radial force. The wedge member and a support member provide support for the seal element to maintain the radial forces on the seal element. In the disclosed embodiments, the support member comprises a tubular mandrel. The wedge member, in the preferred embodiment, comprises a ramped cylinder, while in another embodiment the wedge member comprises one of plural wedge-shaped keys. The support member and the wedge member are constrained to move together during the driving of the seal element against the well casing.

The casing packer also includes a mechanism for releasing the radial forces on the seal element, which comprises a member for releasing the constraint between the wedge and support members to allow the wedge and support members to be longitudinally driven relative to one another to remove the support on the seal element by the wedge member, and thereby release the radial forces.

In the disclosed embodiments of the present invention, the wedge member is constrained to move with the mandrel by means of a resilient member, such as a spring washer. The resilient member drives the wedge member relative to the seal element in response to longitudinal movement of the mandrel. After the seal is set, the resilient member also biases the wedge member and the mandrel in opposite directions to ensure that the radial forces are maintained in the event of thermal creep of the packer.

In both of the embodiments disclosed herein, the casing packer additionally comprises a segmented cylinder, having plural segments disposed between the wedge member and the seal element. The segmented cylinder produces longitudinal gaps between segments of the cylinder during the driving of the seal element against the casing, however, the seal element has sufficient strength to bridge the radial forces across these longitudinal gaps. Preferably, upper and lower cylinders are included to mount the seal element. One or both of these upper and lower cylinders may be sealed to the mandrel through a compressible bellows. The bellows accommodates relative movement between the mandrel and the cylinder during actuation of the seal mechanism.

The seal element is preferably formed of a non-elastomeric material capable of withstanding hostile environments, such as high temperatures. The non-elastomeric seal element is driven beyond its elastic limit by the radial forces during the setting of the seal. The seal element may also include a hinge for accommodating relative movement between the seal element and the mandrel due to thermal expansion and contraction of the casing packer.

In the preferred embodiment, a conically-tapered cylinder is mounted between the wedge member and the mandrel. A driving member, such as a snap-ring, is mounted on the mandrel, to drive cylinder upward in response to longitudinal movement of the mandrel during release of the seal to provide a void or cavity interior to the seal element. This void permits the seal element to deform radially inwardly, thereby alleviating any jamming between the seal element and well casing during removal of the casing packer from the well.

The above-described casing packer may be utilized in a method of selectively sealing the annulus between a well casing and a tube having a seal element mounted thereon. In accordance with such method, the seal element is driven radially outward by direct application of radial force to the seal element by utilizing a wedge member and a support member. The method further includes constraining the wedge member and the support member to move together, in the same longitudinal direction, during the driving of the seal element. Radial forces on the seal element are maintained by supporting the seal element utilizing the wedge member and the support member. The seal is released by driving one of the members longitudinally relative to the other of the members to remove the support on the seal element by the other of the members. In the embodiments disclosed, a void is created interior to the seal element, upon release of the radial forces on the seal element, to permit the seal element to deform radially inwardly. The seal mechanism is preferably removed from the well casing by applying an upward force to the seal element at a location above the casing seal portion, thereby reducing any jamming of the seal element against the casing. Preferably, passage of fluid between the tube and seal element is prevented by sealing between the tube and seal element, for example, by a compressible bellows. Such sealing may be accomplished at a location above the seal element, as well as at a location below the seal element.

The present invention thus solves the problems of the prior art by providing a casing packer and method which seals the annulus between the well casing and a tube extending therein by direct application of radial force to the seal element. This casing packer withstands the externally high temperatures and pressures associated with steam injection EOR applications, as well as other high temperature, high pressure applications, such as geothermal wells. Further, it may be used in wells having a depth of at least 6,000 to 7,000 feet, and thus, dramatically increases the potential amount of heavy oil that is recoverable.

Since the seal is set by applying radial, rather than axial, forces to the seal element, inefficient compressive forces and associated internal stresses are eliminated. Further, this direct application of radial forces permits a wide variety of materials to be used for the seal element, since the materials will not be subjected to as high a stress while operating as it would be with the prior art seals. Thus, the seal element of the present invention may be comprised of any one of a variety of materials including, but not limited to, metals, plastics, and elastomers. This permits selection of a seal material which is best suited to withstand the particular adverse environments of the well in which the casing packer is used. For example, a metal seal material would be particularly suitable for packers used in thermal enhanced oil recovery (EOR) operations, since certain metals, such as brass or nickel, are capable of withstanding, for prolonged periods of time, the extremely high temperatures and chemical environments associated with thermal EOR, which can approach the critical point of steam.

Once the seal is set, it is preferably maintained by a latching mechanism. The latching mechanism permits the pull-up force which actuates the seal mechanism to be relaxed without releasing the seal. Therefore, once the casing packer seal has been set, no active systems or external systems are required to maintain it.

In the embodiments disclosed, the seal may be released by applying a predetermined pull up force, greater than that necessary to set the seal, at the well head. Such pull-up force causes shear pins, which operatively connect the seal mechanism to the mandrel, to shear. This permits the mandrel to move upward relative to the seal mechanism. Such upward movement of the mandrel permits the outer segmented cylinder to collapse against the mandrel, thereby removing the radial forces which retain the seal element against the casing, and releasing the seal.

When the seal mechanism is withdrawn from the well, the mandrel lifts the seal element at its upper end, rather than at its lower end. Therefore, the seal element is pulled from the top rather than pushed, as in prior art seals, from the bottom. Consequently, the seal element will not radially expand if it engages irregularities or protrusions on the casing wall when the packer is pulled from the well. Moreover, increasing the pull-up force will cause the seal element to be urged radially inward, thereby tending to disengage the seal element from the protrusion. Therefore, unlike the prior art seal elements, the seal element of the present invention is jam-resistant.

BRIEF DESCRIPTION OF THE DRAWINGS

These and other advantages of the present invention are best understood through reference to the drawings, in which:

FIG. 7 is an exploded, fragmentary, perspective view of the seal mechanism showing the mandrel, actuating cylinder, and segmented cylinder; in addition, FIG. 7 shows some of the keys which are retained by slots in the actuating cylinder and which mate with corresponding keyways in the segments of the cylinder; in addition, FIG. 7 shows some of the mandrel pockets which receive the keys when the seal mechanism is released;

FIG. 9 is an exploded partial perspective view of the mandrel and actuating cylinder showing the preload springs which bias the actuating cylinder upward with respect to the mandrel;

FIG. 11 is a fragmentary cross section, taken along the plane indicated in FIG. 8, of the seal mechanism showing the mandrel pockets aligned with the actuating cylinder slots to permit the keys to spring radially inward, thereby removing radial forces on the seal element;

FIG. 13 is a fragmentary elevation view, in cross section, showing a second embodiment of the seal mechanism;

FIG. 16 is a fragmentary elevation view, in cross section, showing the ramped surfaces of the ramped cylinder and segmented cylinder interacting to drive the seal element radially outward;

FIG. 17 is a fragmentary elevation view, in cross section, showing the actuating cylinder withdrawn into an annular cavity to release the seal setting forces and permit inward withdrawal of the ramped cylinder, segmented cylinder, and seal element;

DETAILED DESCRIPTION OF THE PREFERRED EMBODIMENT

The present invention is particularly useful for thermal EOR operations, and thus, its use will be described in relation to a thermal EOR environment. However, it will be recognized that the present invention may also be advantageous for other types of applications having high temperature or high pressure environments, such as geothermal wells.

Figure 1:
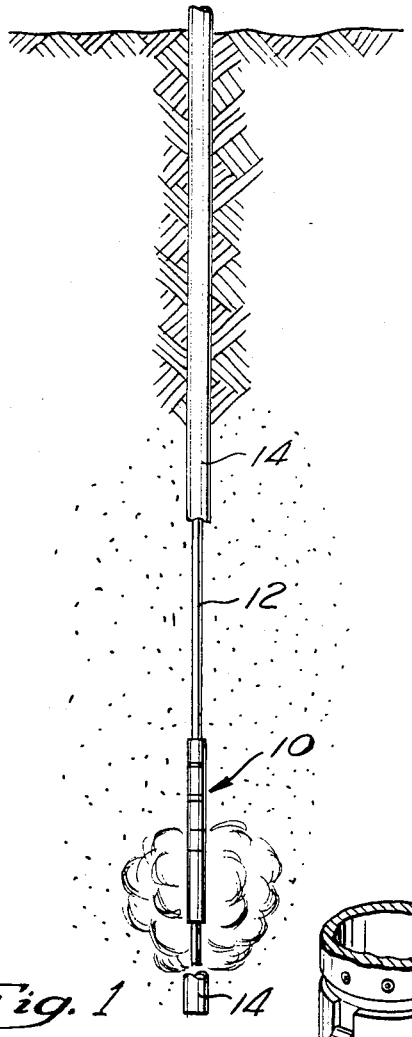
FIG. 1 is an elevation view of the packer of the present invention being used for thermal EOR operations, and shows the packer connected to a steam injection tube which has been lowered into a well casing; a section of the well casing has been cut away to show the packer with steam exiting the end thereof.

The casing packer 10 of the present invention is threaded onto a steam injection string 12 and lowered down the well casing 14 to the desired depth, as shown in FIG. 1.

Figure 2:
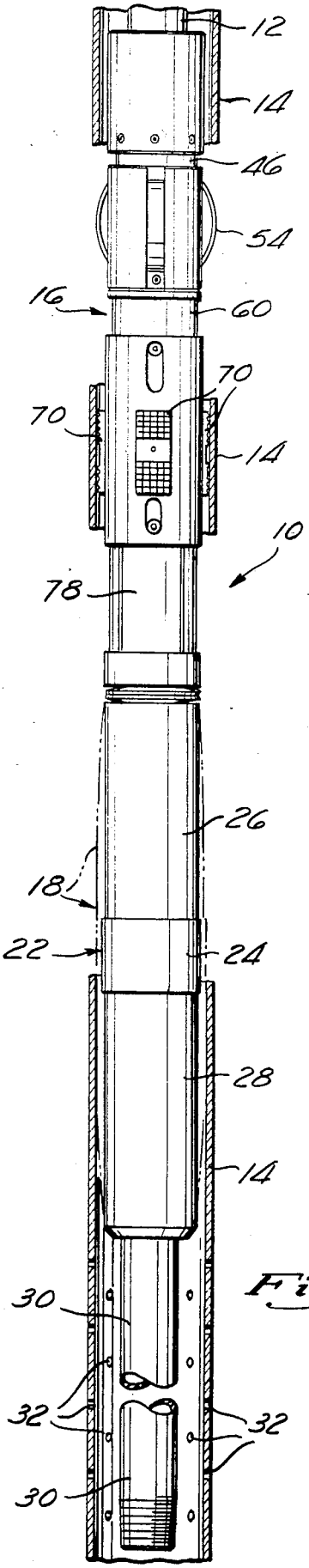
FIG. 2 is an elevation view of the packer within the well casing showing the slip system and seal mechanism.

Referring to FIG. 2, the packer 10 includes a slip system 16 and a seal mechanism 18, mounted on the exterior of a tubular mandrel 30. The slip system 16 comprises plural slips 70 which, when actuated, expand radially outward (as shown in phantom) to grip the casing wall 14 and thereby lock the packer 10 in place. It will be understood, however, that the slip system 16 disclosed herein is illustrative of only one type of prior art slip system and that other types may be used alternatively. In addition, it will be seen that the present invention may, in some cases, be used without a slip system.

The seal mechanism 18 comprises a seal element 22 having a casing seal portion 24, an upper transition portion 26, and a lower transition portion 28. When the seal mechanism 18 is actuated, it expands (as shown in phantom) the seal portion 24 of the seal element 22 radially outward against the casing 14. After the seal element 22 is set, steam is forced through the steam injection string 12. The steam travels through the tubular mandrel 30 and exits the mandrel 30 at the lower end of the packer 10. Alternatively, fuel may be supplied through the mandrel 30 to a downhole steam generator (not shown) located below the casing packer 10. However, in either case, since the seal element 22 prevents the injected steam from rising above it, the steam will be forced through perforations 32 in the wall of the casing 14 and into the surrounding rock formation. This heats any oil contained therein, which decreases its viscosity and permits it to flow to adjacent wells.

Overview of Packer Operation

Setting the packer 10 involves a three-step procedure. The first two steps are directed to actuating the slip system 16, while the third step is directed to actuating the seal mechanism. A fourth step is necessary to release the slip system 16 and seal mechanism 18 after they have been actuated.

The first step in setting the packer 10 consists of rotating the injection string 12, e.g., ten turns clockwise. Such rotation turns a jack screw 46 which drives a cylindrical upper slip wedge 60 beneath the upper portion of the plural slips 70, thereby causing the slips 70 to move radially outward to engage the casing 14, as shown in phantom in FIG. 2. The second step involves applying a pull up force, e.g., of 20,000 pounds, to lift the mandrel 30 upward. Such upward movement of the mandrel 30 drives a cylindrical lower slip wedge 78 beneath the lower portion of the plural slips 70, thereby providing an additional radial force on the slips 70 to cause them to engage the casing 14 more firmly. This locks the packer 10 in place and completes the steps required to set the slip system 16. The slip system 16 is automatically latched to maintain the slip system 16 in a set condition when the pull up force is relaxed or removed.

The third step actuates the seal mechanism 18, and involves applying an increased pull up force, e.g., of 25,000 pounds, on the mandrel 30. This causes the seal mechanism 18 to drive the seal portion 24 of the seal element 22 outward against the casing 14, as shown in phantom in FIG. 2, to set the seal. The seal mechanism 18 is also latched to maintain the seal in a set condition when the pull up force is relaxed or removed.

The fourth and final step releases both the slip system 16 and seal mechanism 18. This step involves applying a further increased pull up force, e.g., of 30,000 pounds, on the mandrel 30. Such pull up force causes the radial forces retaining the slips 70 and seal 22 against the casing 14 to be removed, and thereby permits the packer 10 to be pulled up the well casing 14 and out of the well.

The Slip System 16

The entire slip system 16, except for the spring washer 90 (described below), is known in the prior art. It will be recognized that the slip system 16 disclosed herein is merely illustrative of one type of slip system that may be used with the present invention, and that other types may be used alternatively. Further, it will be understood that, in some applications, the present invention may not require a slip system to lock the packer 10 in place, the packer 10 being locked by the engagement of the seal element 22 with the casing 14.

Figure 3:
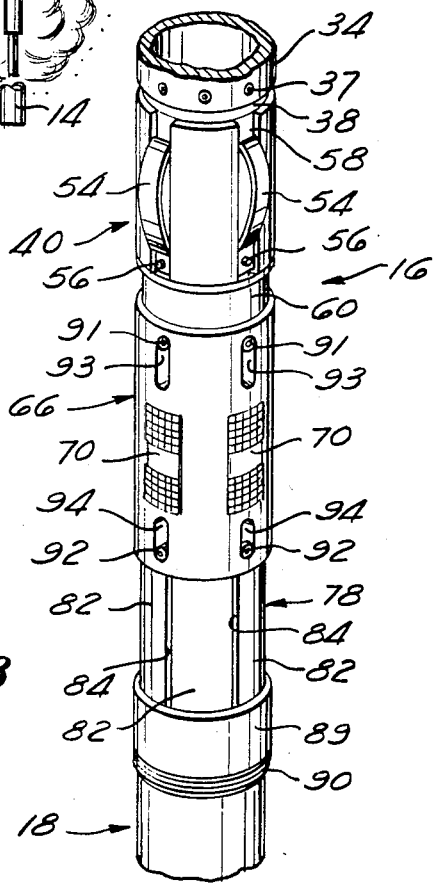
FIG. 3 is a perspective view of the slip system.
Figure 4:
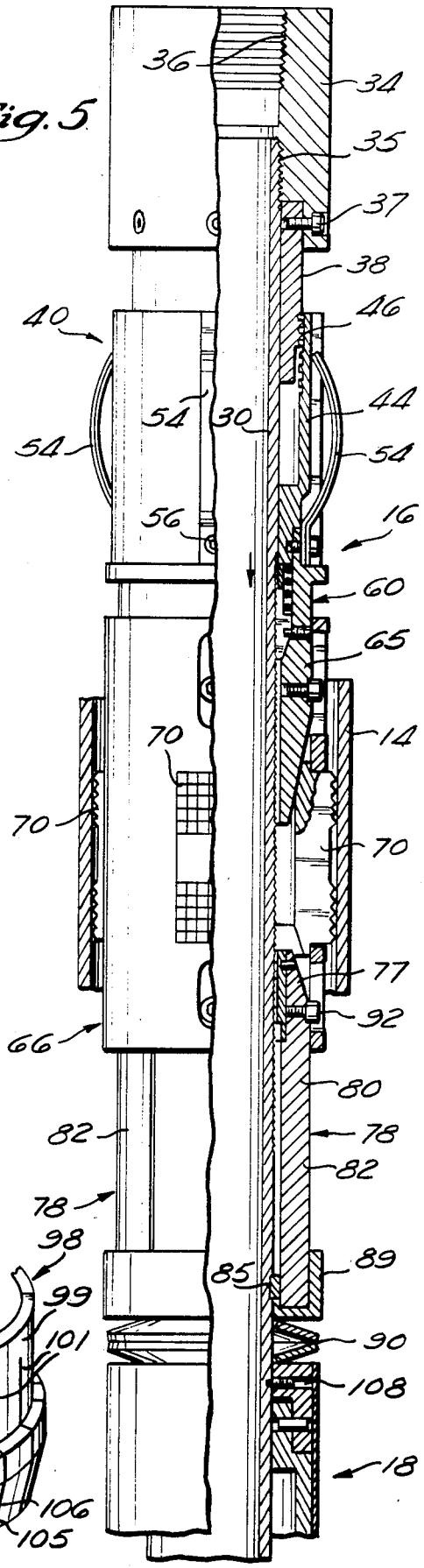
FIG. 4 is an elevation view in partial cross section of the configuration of the slip system as it is lowered into the well casing.

Referring to FIGS. 3 and 4, the mandrel 30 is threaded onto a connecting collar 34 by means of screw threads 35. The collar 34 also includes threads 36 which receive corresponding threads (not shown) on the steam injection string 12 (FIG. 2) to permit the packer 10 to be connected to the string 12. The lower end of the collar 34 is connected, by means of bolts 37, to a cylinder 38 which surrounds the mandrel 30.

A drag spring carrier 40 is telescopingly mounted on the mandrel 30 just below the collar 34. This carrier 40 comprises a cylindrical lower portion 42 which telescopes over the mandrel 30 and a cylindrical upper portion 44 which forms an annular pocket 45 with the mandrel 30. The pocket 45 is sized to receive the cylinder 38. The drag spring carrier's upper portion 44 has interior threads which mate with corresponding threads on the cylinder 38. Thus, the cylinder 38 and carrier upper portion 44 cooperate to form a jack screw 46.

Four drag springs 54 are oriented longitudinally along and spaced in quadrature about the drag spring carrier 40. The springs 54 are formed as resilient arcuate members and are connected at only one of their ends to permit them to lie flat against the carrier 40 when fully compressed. Such connection is made by means of bolts 56 at the lower end of the carrier 40. Longitudinal channels 58 are included in the carrier 40 to provide tracks or guides for the free ends of the drag springs 54. The drag springs 54 are sized to permit them to partially compress against the casing wall 14 when the packer 10 is lowered down the well. This compression creates sufficient tension, or drag, between the casing 14 and springs 54 to prevent the carrier 40 from rotating relative to the casing 14.

Beneath the drag spring carrier, and connected thereto by the bolts 56, is an upper slip wedge 60. The slip wedge 60 is a cylinder, concentric with the mandrel 30, and spaced therefrom by a small annular gap 61. As will be understood more fully below, the gap 61 is just large enough to permit the slip wedge 60 to travel down the mandrel 30 without contacting multi-lead screw threads 62 on the mandrel 30.

The slip wedge 60 has a lower portion 64 and an upper portion 65. The exterior surface of the lower portion 64 is tapered to form a conical wedge, while the exterior surface of the upper portion 65 is cylindrical. The lower portion 64 and upper portion 65 will be referred to hereinafter as the wedge portion 64 and the base portion 65, respectively. A slip carrier 66, comprised of a cylinder concentric with the mandrel 30, has upper, central, and lower portions. The upper portion of the carrier 66 telescopes over the base portion 65 of the slip wedge 60.

Figure 5:
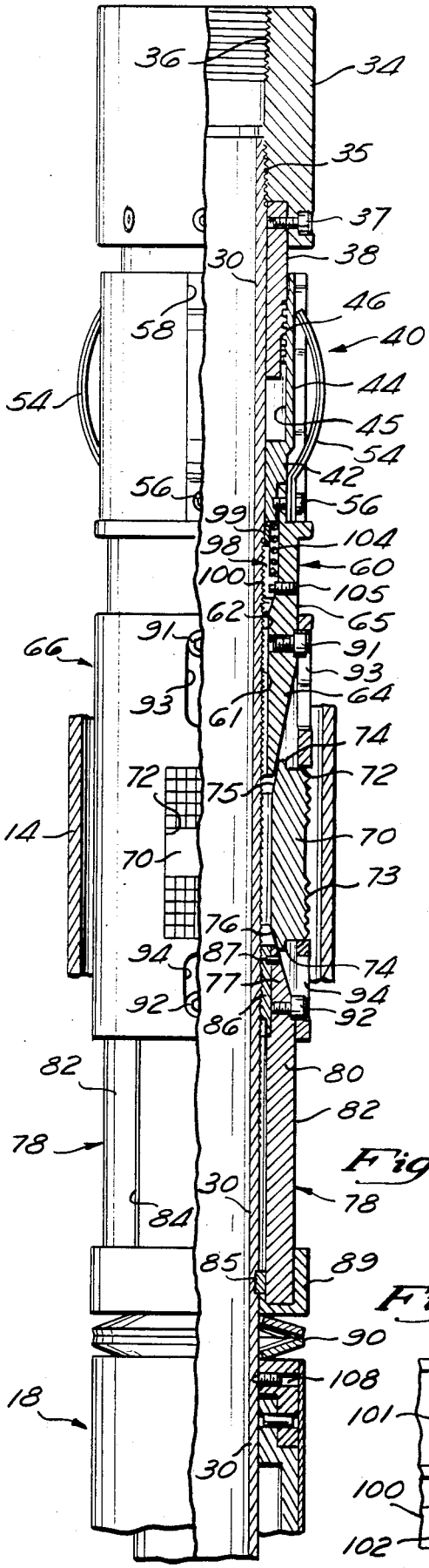
FIG. 5 is an elevation view in partial cross section similar to FIG. 4 showing the drag spring carrier after it has been driven down the mandrel to drive the upper slip wedge between the mandrel and the plural slips, thereby causing the plural slips to engage the well casing.

Four slips 70 are disposed in quadrature within the central portion of the slip carrier 66. The slips 70 are mounted in respective cutouts 72 in the walls of the slip carrier 66, and are shaped as rectangular blocks having serrations or teeth 73 on their exterior faces which engage the casing 14 when the slips 70 are driven radially outward, as shown in FIG. 5. Referring back to FIG. 4, projections or stops 74 are included adjacent the interior faces of the slips 70 to prevent them from passing completely through the cutouts 72. In addition, the interior face of the slips 70 have tapered upper and lower edges 75, 76 which abut the leading edge of the wedge portion 64 of the upper slip wedge 60, and a leading edge of a wedge portion 77 of a lower slip wedge 78, respectively.

Like the upper slip wedge 60, the lower slip wedge 78 is comprised of a cylinder, concentric with the mandrel 30, and has base portion 80, over which the slip carrier 66 telescopes. However, unlike the cylinder of the upper slip wedge 60, the cylinder of the lower slip wedge 78 is comprised of plural longitudinal segments 82 (FIG. 3) with longitudinal gaps 84 therebetween. Further, each segment 82 of the slip wedge 78 is offset from the mandrel 30 by a snap ring 85, which is retained by an annular groove in the mandrel 30, and a support ring 86, which is retained by a shear pin 87, attached to the slip wedge 78. The support ring 86 is disposed between the mandrel 30 and the wedge portion 77 and the snap ring 85 is disposed between the mandrel 30 and the base portion 80. Thus, the rings 85, 86 prevent the segments 82 from collapsing against the mandrel 30. However, the longitudinal gaps 84 permit such collapse upon removal of the rings 85, 86.

A wedge retaining collar 89, which telescopes on the mandrel 30, is provided to support the lower edges of the segments 82. The collar 89 is supported by a slip preload spring 90 comprising, for example, a pair of spring washers. The spring 90 is mounted on the mandrel 30 between the collar 89 and the seal mechanism 18 and is compressed upon actuation of the slip system 16 to provide a biasing force on the wedge 78. Such biasing force maintains the slip system 16 in a set condition and prevents the slip system 16 from being affected by vibration, thermal cycling, or long-term creep of the packer components.

The slip carrier 66 is retained on the base portions 65, 80 of the slip wedges 60, 78, respectively, by respective sets of bolts 91, 92. The heads of these bolts 91, 92 are received by longitudinal slots 93, 94, respectively, in the slip carrier 66, and the bolts 91, 92 cooperate with the slots 93, 94 to support the slip carrier 66 and prevent it from rotating relative to the wedges 60, 78. Further, the bolts 91, 92 are positioned relative to the slots 93, 94, respectively, to permit the slip wedges 60, 78 to move towards each other, while preventing them from moving away from each other.

An inner slip 98 is disposed above the gap 61 between the base portion 65 of the upper slip wedge 60 and the mandrel 30. The inner slip 98 is a cylinder, concentric with the mandrel 30, having an upper band portion 99, which telescopes on the mandrel 30, and a lower threaded portion 100. The threaded portion 100 is resilient and has plural longitudinal slits 101 (FIG. 4A) which permit it to spring radially outward. The portion 100 is threaded onto the multi-lead threads 62 of the mandrel 30. The threads 62 extend well down the mandrel 30 to a point just above the slips 70. The inner slip 98 has a ramped portion 102 (FIG. 4A and FIG. 12) which is biased against an inclined surface 103 (FIG. 4A and FIG. 12) of the slip wedge 60 by a slip spring 104.

When a pull-up force is applied to the mandrel 30, the mandrel threads 62 urge the ramped portion 102 up. Once the ramped portion 102 is raised, the inclined surface 103 permits expansion of the surface 102, thereby permitting the threaded portion 100 to spring radially outward from the mandrel 30 by an amount which permits it to disengage the mandrel threads 62. However, the slip spring 104 will continually resist such disengagement and urge the ramped portion 102 down the inclined surface 103 to cause the thread to tend to re-engage. Thus, the slip spring 104 and the inclined surface 103 cooperate to permit the mandrel threads 62 to ratchet upward over the threads of the inner slip 98. Therefore, the inner slip 98 permits the mandrel 30 to move upward relative to the slip wedge 60, but prevents it from moving downward. This ratchet action of the inner slip 98 with the mandrel 30 maintains the slip system 16 in a locked condition after it has been actuated. The mandrel 30, however, is free to move up within the locked slip system.

Figure 4A:
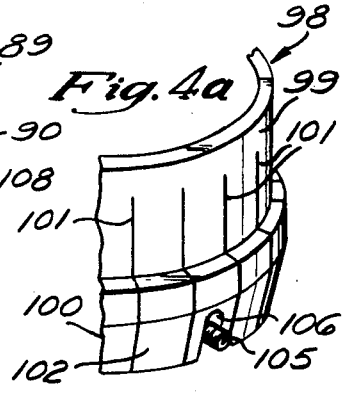
FIG. 4A is an enlarged, exploded, partial perspective view of the inner slip of the slip system, showing the alignment pin which prevents the inner slip from rotating relative to the upper slip wedge and drag spring carrier.

The inner slip 98 is prevented from rotating relative to the upper slip wedge 60 by a pin 105 which is connected to the wedge 60 and is received by a longitudinal slot 106 in the inner slip 98, as shown in FIG. 4A. The slot 106 has sufficient length to permit the inner slip 98 to move upward, along the ramped surface 103, and thus, the pin 105 will not inhibit the above-described ratchet action of the mandrel 30 and inner slip 98.

Operation of the Slip System 16

As mentioned above, the slip system 16 is illustrative of one type of prior art system that may be used in the present invention, and other types may be used alternatively. The slip system 16 is actuated by rotating the injection string 12 (FIG. 2) clockwise ten turns and then applying a pull up force, e.g., of 20,000 pounds, on the mandrel 30.

Since the collar 34 connects the string 12 (FIG. 2) to the mandrel 30, rotation of the string 12 will also cause the mandrel 30 to rotate. However, as mentioned above, the drag springs 54 create sufficient tension between the drag spring carrier 40 and the casing 14 to prevent the carrier 40 from rotating with the mandrel 30. Further, it will be recalled that the cylinder 38 and drap spring carrier upper portion 44 cooperate to form a jack screw 46. Since the cylinder 38 is connected to rotate with the mandrel 30, and since the carrier upper portion 44 will remain stationary during such rotation, the jack screw 46 formed by these members will drive the drag spring carrier 40 downward with respect to the mandrel 30. Such downward movement of the drag spring carrier 40 will continue until the engagement of the jack screw threads terminates and the carrier 40 is disengaged from the cylinder 38. It should be noted that the mandrel threads 62 drive the inner slip 98 down the mandrel 30 at the same rate the jack screw 46 drives the drag spring carrier 40 down the mandrel 30. Thus, the inner slip 98 does not inhibit or affect the action of the jack screw 46.

As the drag spring carrier 40 moves downward relative to the mandrel 30, the wedge portion 64 of the upper slip wedge 60 will be driven between the mandrel 30 and the slips 70. This will force the slips 70 radially outward by an amount sufficient to permit them to engage the casing 14, as shown in FIG. 5. The engagement between the slips 70 and casing 14 initially locks the packer 10 (FIG. 2) in place so that the slip system 16 can be more firmly set by applying a pull up force on the mandrel 30.

Figure 6:
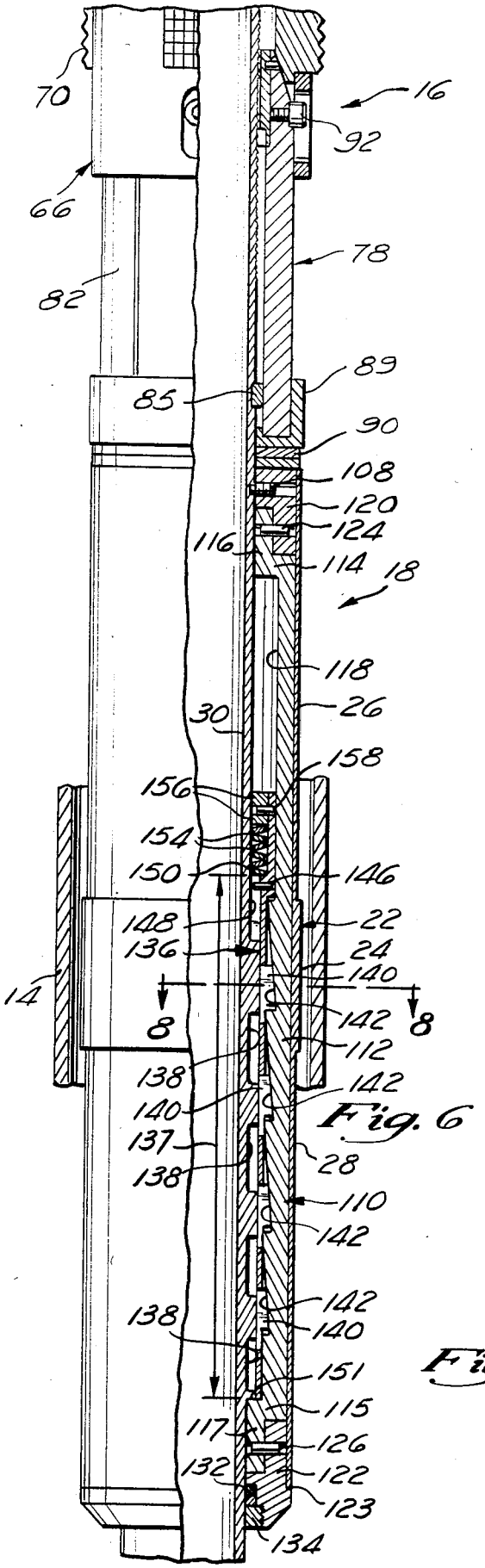
FIG. 6 is an elevation view in partial cross section, taken along the plane indicated in FIG. 8, showing the seal mechanism and the lower portion of the slip system with the lower slip wedge driven between the plural slips and the mandrel to cause the slips to more firmly engage the casing.

To complete the process of setting the slip system 16, a pull up force of, e.g., 20,000 pounds is applied to the mandrel 30. This causes the mandrel 30 to ratchet over the inner slip 98, as described above, which permits the mandrel 30 to move upward relative to the drag spring carrier 40, upper slip wedge 60, and slip carrier 66. However, as will be understood more fully below, the seal mechanism 18 is prevented from moving relative to the mandrel 30 by shear pins 108. Thus, the seal mechanism 18 will move upward with the mandrel 30. Since the slip preload spring 90 is interposed between the wedge retaining collar 89 and the seal mechanism 18, such upward movement of seal mechanism 18 will force the spring 90 against the collar 89 and thereby drive the lower slip wedge 78 upward between the slips 70 and the mandrel 30, as shown in FIG. 6. This provides an additional radial force on the slips 70 and causes them to more firmly engage the casing wall. Such engagement of the slips 70 and casing 14 locks the packer in place. Further, since the inner slip 98 prevents the mandrel 30 from moving downward, the slip 98 functions as a latch to retain the slips 70 in a set and locked condition even when the pull up force is relaxed or removed.

It should be noted that when the lower slip wedge 78 is driven upward by the force of the seal mechanism 18 on the slip collar 89, the pull up force is sufficient to compress the slip preload spring 90, as shown in FIG. 6. The preload spring 90 is designed to provide a load of approximately 6,500 pounds between the slip wedge collar 89 and the seal mechanism 18. Since, as previously mentioned, the seal mechanism 18 is prevented from moving relative to the mandrel 30 by the shear pin 108, this load will tend to drive the slip wedge 78 upward relative to the mandrel 30. This maintains the slips 70 in a set and locked condition, even though they may be subjected to vibration, thermal cycling, and long-term creep of the packer components.

The Seal Mechanism 18

As previously mentioned, the seal mechanism 18, shown in FIG. 6, comprises a seal element 22 having a casing seal portion 24, an upper transition portion 26, and a lower transition portion 28.

Figure 8:
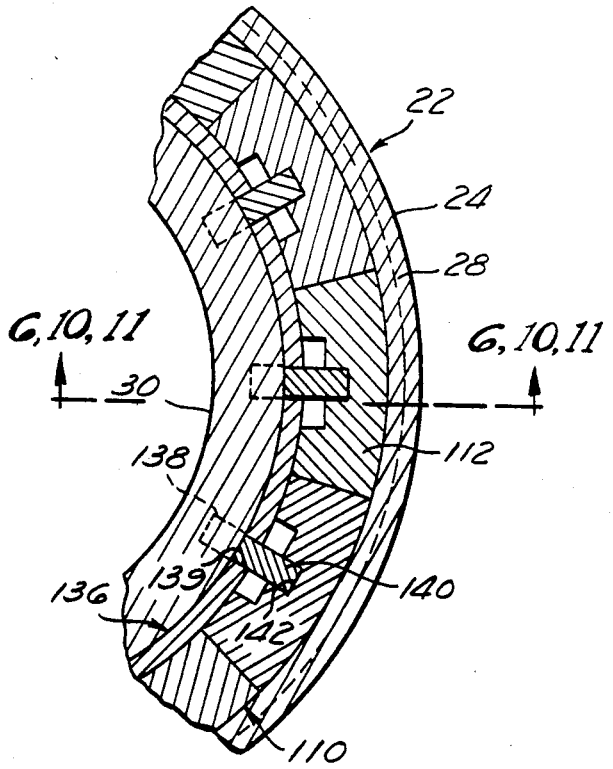
FIG. 8 is a partial cross section taken along the line 8—8 of FIG. 6.

The seal element 22 is mounted on the exterior of a segmented cylinder 110, as shown in FIGS. 6 and 8, and fastened thereto, at its upper end, by screws (not shown). This cylinder 110 is comprised of plural longitudinal segments 112, as shown in FIGS. 6, 7, and 8, and thus the segments 112 provide a substruction for the seal element 22. The upper and lower ends of each of the segments 112 have radial offsets 114,115, respectively, which offset the segments 112 from the mandrel 30. Thus, the radial offsets 114,115 abut the mandrel 30, while the remaining portions of the segments 112 are separated therefrom by a space 118. The offsets 114,115 have flanges 116,117 which are retained against the mandrel 30 by means of annular headers 120,122 which have respective central portions that telescope over the mandrel 30 and respective boss portions that telescope over the flanges 116,117, respectively. Thus, the headers 120,122 retain the offsets, 114,115 against the mandrel 30. The headers 120,122 are sized to permit their outer surface to be flush with the exterior of the segmented cylinder 110. This allows the upper and lower transition portions 26,28 of the seal 22 to extend past the ends of the segmented cylinder 110 and onto the headers 120,122, respectively. The seal element 22 is supported by a shoulder 123 on the lower header 122, and may be welded thereto. Pins 124,126 connect the offsets 114,115, respectively, to prevent movement of the segmented cylinder 110 relative to the headers 120,122. In addition, the upper header 120 is connected to the mandrel 30 by means of the shear pin 108 to prevent the header 120 from rotating or sliding relative to the mandrel 30. Thus, the pin 108 cooperates with the pins 124,126 to prevent the segmented cylinder 110 from moving relative to the mandrel 30.

In the embodiment disclosed herein, a seal 132 is provided in an annular slot between the mandrel 30 and the lower header 122 to prevent gas or fluid from traveling between the mandrel 30 and lower header 122. This seal 132 is retained by a retainer ring 134 which is threaded into the slot and driven against the seal 132. It will be recognized, however, that there are many other types of seals known in the prior art that are suitable for use in the present invention.

An actuating cylinder 136 is disposed within the annular space 118 between the mandrel 30 and the segmented cylinder 110. The length of the actuating cylinder 136 is less than the length of the annular space 118 to permit vertical movement of the cylinder 136 therein. The actuating cylinder 136 is supported by the lower radial offsets 115 of the segments 112 and extends upward to a position above the casing seal portion 24 of the seal element 22, as shown in FIG. 6.

The actuating cylinder 136 telescopes on the portion of the mandrel 30 represented by the dimension 137. This portion 137 of the mandrel 30 has an increased diameter which permits pockets 138 to be cut in the exterior walls of the mandrel 30. Preferably, the pockets 138 have a depth equal to such increase in diameter to prevent them from weakening the mandrel 30.

Referring to FIGS. 7 and 8, the actuating cylinder 136 has plural longitudinal slots 139 extending therethrough which are sized to receive inserts comprising wedge-shaped keys 140. These wedge-shaped keys 140 will be referred to herein as "ramped keys". The ramped keys 140 are positioned in the slots 139 so that they are flush with the interior of the cylinder 136 and abut the exterior of the mandrel 30, with their ramps or wedges extending radially outward. The ramped keys 140 are received by corresponding wedge-shaped, ramped keyways 142 in the interior wall of the segmented cylinder 110. The keys 140 and keyways 142 are positioned so that upward movement of the keys 140 relative to the keyways 142 will tend to drive the cylinders 136,110 apart.

The number and spacing of the keys 140 and keyways 142 may be varied, depending on design conditions. However, these parameters are preferably chosen so that the keys 140 and keyways 142 provide sufficient support between the cylinders 136,110 when the seal mechanism 18 is actuated. By way of specific example, each of the segments 110 of the embodiment disclosed herein utilizes three double pairs of keys 140 and keyways 142, alternately spaced between four single pairs of keys 140 and keyways 142, as partially shown in FIG. 7.

The mandrel 30 has respective longitudinal recesses or pockets 138 positioned just below each of the slots 139, as shown in FIGS. 6 and 7. A pin 146, attached to the actuating cylinder 136, cooperates with a longitudinal channel 148 in the mandrel 30 to maintain longitudinal alignment of the pockets 138 with the slots 139, while permitting vertical movement of the pockets 138 relative to the slots 139.

The larger diameter portion 137 of the mandrel 30 forms upper and lower annular shoulders 150,151 with the smaller diameter portions of the mandrel, as shown in FIG. 6. The lower shoulder 151 abuts the lower offset 115 to prevent the mandrel 30 from sliding downward relative to the segmented cylinder 110. The upper shoulder 150 provides a support surface for preload springs 154. The preload springs 154 may, for example, comprise spring washers and are mounted on the smaller diameter portion of the mandrel 30, just above the shoulder 150. The springs 154 are retained between the shoulder 150 and a shear pin ring 156 disposed between the actuating cylinder 136 and the mandrel 30, as shown in FIGS. 6 and 9. The shear pin ring 156 is connected to the actuating cylinder 136 by a shear pin 158. However, the ring 156 is permitted to slide vertically on the mandrel 30. As will be discussed below, when the seal mechanism 18 is actuated, the springs 154 bias the actuating cylinder 136 upward relative to the mandrel 30 to maintain the radial force on the seal element 22.

Actuating the Seal Mechanism 18

Figure 10:
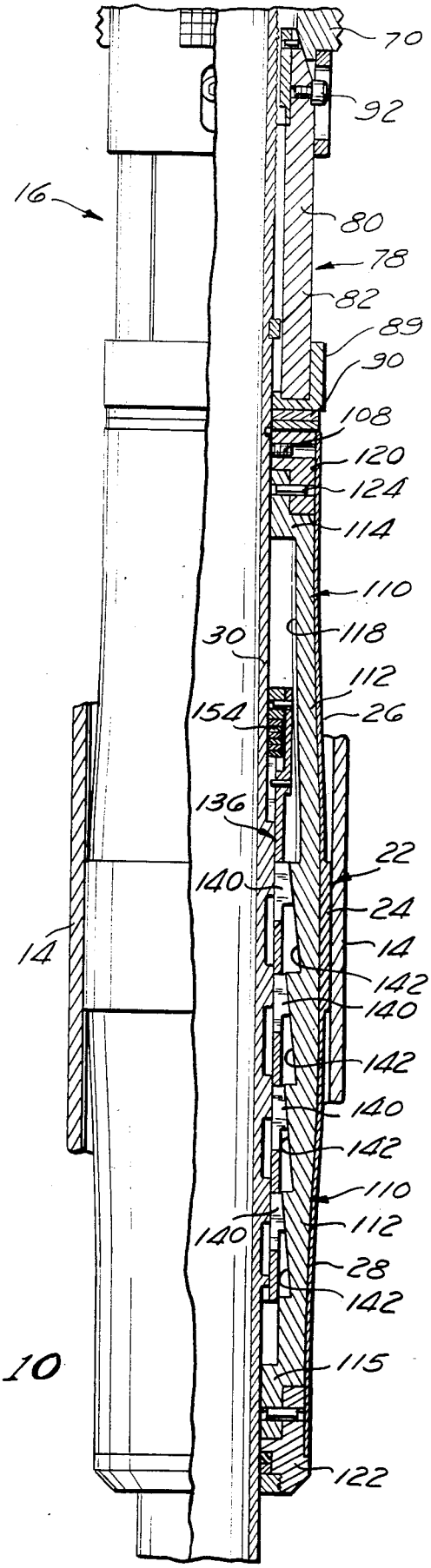
FIG. 10 is an elevation view in partial cross section, taken along the plane indicated in FIG. 8, showing the seal mechanism with the ramped keys of the actuating cylinder and the ramped keyways of the segmented cylinder interacting to drive the seal element radially outward against the casing.

The seal mechanism 18 is actuated by applying e.g., a 25,000 pound pull-up force on the mandrel 30. This pull up force is sufficient to cause the shear pins 108 to shear, as shown in FIG. 10, and thereby permits the mandrel 30 to move upward relative to the segmented cylinder 110. Such upward movement of the mandrel 30 forces the upper mandrel shoulder 150 against the preload springs 154 to compress them. The compression of the springs 154 provides a biasing force against the shear pin ring 156. Since the shear pin ring 156 is connected to the actuating cylinder 136 by means of the shear pin 158, such spring biasing force will drive the actuating cylinder 136 upward, along the mandrel 30. Thus, the pull up force drives both the mandrel 30 and the actuating cylinder 136 upward relative to the segmented cylinder 110.

It will be recalled that the ramped keys 140 are retained in slots 139 (FIG. 7) in the actuating cylinder 136 and are aligned to mate with corresponding ramped keyways 142 in the segments 112 of the cylinder 110. Thus, above-described movement of the actuating cylinder 136 with respect to the segmented cylinder 110 causes the ramped keys 140 to cooperate with the ramped keyways 142 to drive the segments 112 of the segmented cylinder 110 radially outward. Since the seal element 22 surrounds the segmented cylinder 110, such radial movement of the cylinder 110 drives the seal element 22 firmly against the casing 14. This sets the packer seal and permits thermal EOR operations to commence. It will be understood that, although the above-described movement of the segmented cylinder 110 creates gaps between the individual segments 112, these gaps are sufficiently small, in relation to the thickness of the seal element 22, that the seal element 22 bridges the seal setting forces across the gaps.

It should be noted that when the pull up force is applied to actuate the seal mechanism 18, the mandrel 30 will move upward with respect to the slip system 16, as well as the seal mechanism 18. Thus, such upward movement will cause the mandrel 30 to ratchet over the inner slip 98 of the slip system 16, as described above. Since the inner slip 98 prevents the mandrel 30 from moving downward once it has been lifted, the pull up force may be relaxed or removed without releasing the seal. Thus, once the seal is set, no active systems are required to maintain it. Further, since the preload springs 154 were compressed during actuation of the seal mechanism 18, these springs 154 will continually bias the actuating cylinder 136 upward relative to the mandrel 30 to compensate for any creep or permanent set that may occur in the seal mechanism components. Therefore, the inner slip 98 of the slip system 16 and the preload springs 154 of the seal mechanism 18 cooperate to form a latch which maintains radial force on the seal element 22 and thereby provides a continuous load on the seal 22 to retain it firmly against the casing 14.

As mentioned above, the ends of the segmented cylinder 110 are retained against the mandrel 30 by the headers 120,122. Therefore, when force is applied to drive the cylinder 110, and thus the seal element 22, radially outward, the cylinder 110 and seal element 22 will bow. Thus, only the casing seal portion 24 of the seal element 22 will firmly engage the casing 14, and radial distension of the upper and lower transition portions 26,28 will progressively decrease from a maximum at the seal portion 24 to nil at the headers 120,122, respectively. The upper and lower transition portions 26,28, therefore, are preferably of a length which is sufficient to permit such variable distension to occur without creating significant stresses on the seal material and without approaching the yield point of the material comprising the segments 112. This insures that the effectiveness of the seal will be maintained and permits the segments 112 to return to their original shape after the seal is released. In addition, it will be recognized that as the seal 22 and segments 112 bow, the lower portion of the seal mechanism 18 will slide upward relative to the mandrel 30 to accommodate such bowing.

Referring again to FIGS. 6 and 7, the keys 140 are sized, positioned, and provided in sufficient numbers to adequately support the segments 112, and thereby prevent them from being permanently deformed by the force exerted on the lower transition portion 28 due to the high pressure of the injected steam. Accordingly, the keys 140 and cooperating keyways 142 are provided, in the pattern described above, through the portion of the segments 112 adjacent to the lower transition and seal casing portions 24,28, as shown in FIG. 7. Typically, no such support is necessary for a portion of the segment 112 adjacent the upper transition portion 26, since this portion is normally not in contact with the high pressure steam. The key 140 and keyway 142 pairs vary in size to provide a radial distension at the seal portion 24 that is sufficient to drive the seal portion firmly against the casing 14, and progressively less radial distension through the lower transition portion 28, from the seal casing portion 24 to the header 122. Thus, the keys 140 and keyways 142 accommodate the previously described bowing of the segments 112.

Since the segmented cylinder 110 provides a substruction for the seal element 22, it bears the upward forces exerted by the high pressure fluid (e.g., the steam or gas in the lower portion of the well) on the seal element 22. Thus, it is not necessary that the seal element 22 have a high degree of structural strength, although it must be sufficiently strong to bridge the previously described gaps between the segments 112. When the slip system 16 is set and the seal mechanism 18 actuated, these upward forces are transferred by the substruction to the frictional interfaces between (a) the segments 112 and the seal 22, and (b) between the seal 22 and the casing wall 14, and are distributed throughout such interfaces. This virtually eliminates the stress concentrations associated with prior art seals. Moreover, the seal mechanism 18 may be used to hold the packer in place without reliance on the slip system 16 by providing sufficient radial force on the seal element to cause the frictional interface between the seal 22 and the casing 14 to absorb all of the forces applied by the high pressure steam.

Releasing the Packer 10

The packer 10 is released from the well casing 14 by applying a pull up force, e.g., of 30,000 pounds on the mandrel 30. This causes the shear pin 158, which connects the shear pin ring 156 to the actuating cylinder 136, to shear, as shown in FIG. 11, thereby allowing the mandrel 30 to move upward with respect to both the actuating cylinder 136 and segmented cylinder 110. The initial movement of the mandrel, typically about an inch and a half, brings the pockets 138 to a point adjacent with the slots 139 (FIG. 7) of the cylinder 136. When the pockets 138 coincide with the slots 139, the resilience of the segments 112 will force the keys 140 radially inward and into the pockets 138. This permits the segments 112 of the segmented cylinder 110 to concomitantly spring radially inward and collapse against the actuating cylinder 136, as shown in FIG. 11, thereby removing all radial forces on the seal element 22, and thus, releasing the seal.

Since the springs 154 and shear pin ring 156 are supported by the shoulder 150 of the mandrel 30, continued upward movement of the mandrel 30 will force the springs 154 and ring 156 against the offsets 114 of the segmented cylinder 110, as shown in phantom in FIG. 11. This movement of the mandrel 30 will also lift the actuating cylinder 136 upward, since the alignment pin 146, which is connected to the actuating cylinder 136, will be carried by a shoulder 160 formed by the bottom of the alignment channel 148. Thus, it is apparent that further movement of the mandrel 30 will tend to lift the entire seal mechanism 18 from the well.

Figure 12:
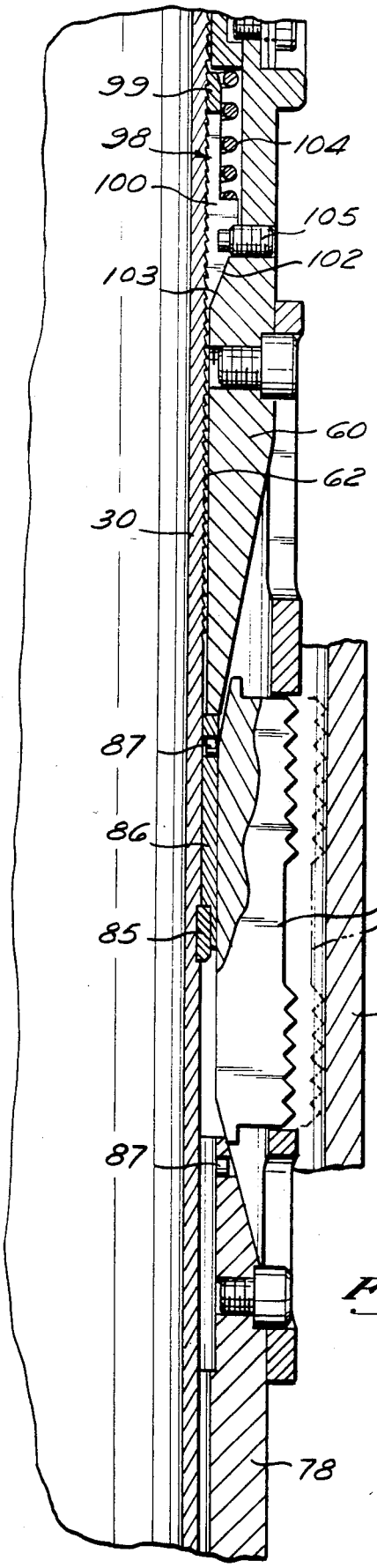
FIG. 12 is a fragmentary cross section showing the slip system after it has been released by upward movement of the snap ring and support ring.

The release of the slip system 16 is accomplished concomitantly with the release of the seal mechanism 18. Specifically, when the above-mentioned 30,000 pounds pull-up force is applied to the mandrel 30 and the mandrel begins moving upward, the snap ring 85 (FIG. 4) will move upward therewith to a position beneath the support ring 86 (FIG. 4). Additional upward movement of the mandrel 30 causes the snap ring 85 to exert sufficient force on the support ring 86 to shear the shear pin 87 and drive the support ring 86 beneath the slip 70, as shown in FIG. 12. This removes all support for the segments 82 of the colleted lower slip wedge 78, and thereby permits the wedge 78 to collapse against the mandrel 30. Such collapse of the wedge 78 removes support for the lower end of the slip 70. Further, upward movement of the mandrel 30 will drive the rings 85,86 against the upper slip wedge 60 which causes the wedge 60 to move upward with the mandrel 30 relative to the slip 70. Such upward movement of the wedge 60 relative to the slip 70 removes support for the upper end of the slip 70 and permits the slip 70 to collapse against the mandrel 30, as shown in FIG. 12.

Thus, the 30,000 pound pull-up force and resultant upward movement of the mandrel 30 relative to both the slip system 16 and seal mechanism 18 releases the engagement of both the slips 70 and seal element 22 and permits the packer 10 to be lifted from the well casing 14.

Referring back to FIG. 11, it will be recalled that, when a pull up force is applied to lift the packer 10 from the well, the shear pin ring 156 abuts, and bears against, the radial offsets 114 to support the segmented cylinder 110 on the mandrel 30. Thus, the pull up force applied to the mandrel 30 is transferred to the cylinder 110 and seal 22 at this point of abutment, designated by the numeral 170. The point of abutment 170 is near the upper end of the seal 22, above the casing seal portion 24, and preferably also above the distended portion of the transition portion 26, as clearly seen in FIG. 11. Thus, when the mandrel 30 is pulled upward, the seal 22 is pulled from its upper end rather than pushed from its lower end. This is significant, since if the seal 22 were to engage an irregularity or protrusion on the casing wall as it is pulled from the well, pushing from the lower end may cause the seal 22 to expand or buckle, and thus, jam against the casing in a manner similar to prior art compressible seals. However, by pulling the seal 22 from its upper end, the risk of such jamming is virtually eliminated since tensile forces cannot expand or buckle the seal.

Further, it should be noted that, if the seal element 22 is formed of a relatively non-resilient material such as a malleable metal, the seal element may be flexed beyond its elastic limit, and thus, may not return against the segmented cylinder 110 of its own accord. Accordingly, the seal element 22 may remain distended, nearly in contact with the casing 14, with a void 180 between the seal element 22 and the segmented cylinder 110. However, even if this occurs, the above-described pulling of the seal element 22 from its upper end will cause the seal element 22 to slide in the casing without jamming. Moreover, even if the casing 14 narrows in diameter as the seal element 22 is lifted out of the well, the bow-shaped configuration of the seal element 22 permits such narrower diameter portion to force the seal element 22 radially inward, towards the segmented cylinder 110, to allow the seal element 22 to pass through the casing 14 without jamming. Further, the bow-shaped configuration of the seal element 22 eliminates any horizontal surfaces which might hook on projections or irregularities in the casing wall. Thus, the seal mechanism 18 of the present invention is resistant to jamming. Further, if any jamming does occur, the fact that the seal 22 is pulled rather than pushed from the well permits the jamming to be overcome simply by increasing the pull up force.

Preferably, the seal element 22 is formed of a pliant material to permit it, when driven against the casing 14, to adapt to irregularities in the casing wall. Such materials, for example, may include plastics, elastomers, and metals. If the packer of the present invention is used in thermal EOR operations, the seal element 22 is preferably of a metal material, capable of withstanding the high temperature, high pressure, environments associated with thermal EOR in wells greater than 2,000 feet in depth. This prevents the injected steam from melting or deforming the seal element 22. Brass or nickel, for example, provides both the pliant properties and ability to withstand high temperatures and pressures required.

Alternative Seal Mechanism 218

Figure 14:
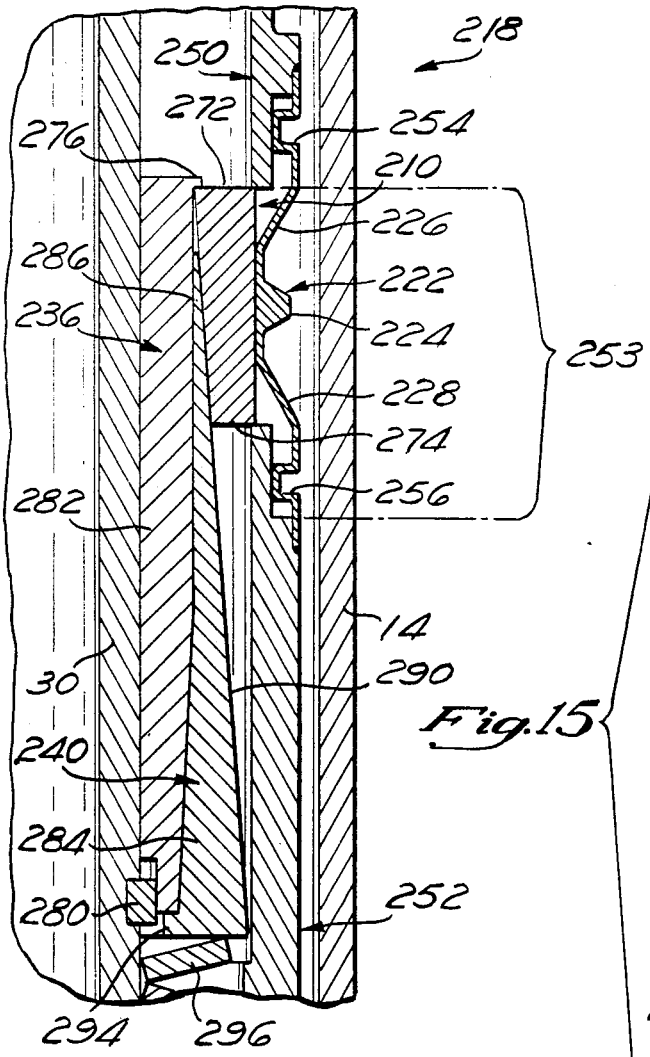
FIG. 14 is an enlarged cross sectional view showing the actuating cylinder, ramped cylinder, and segmented cylinder, and seal element of FIG. 13.
Figure 15:
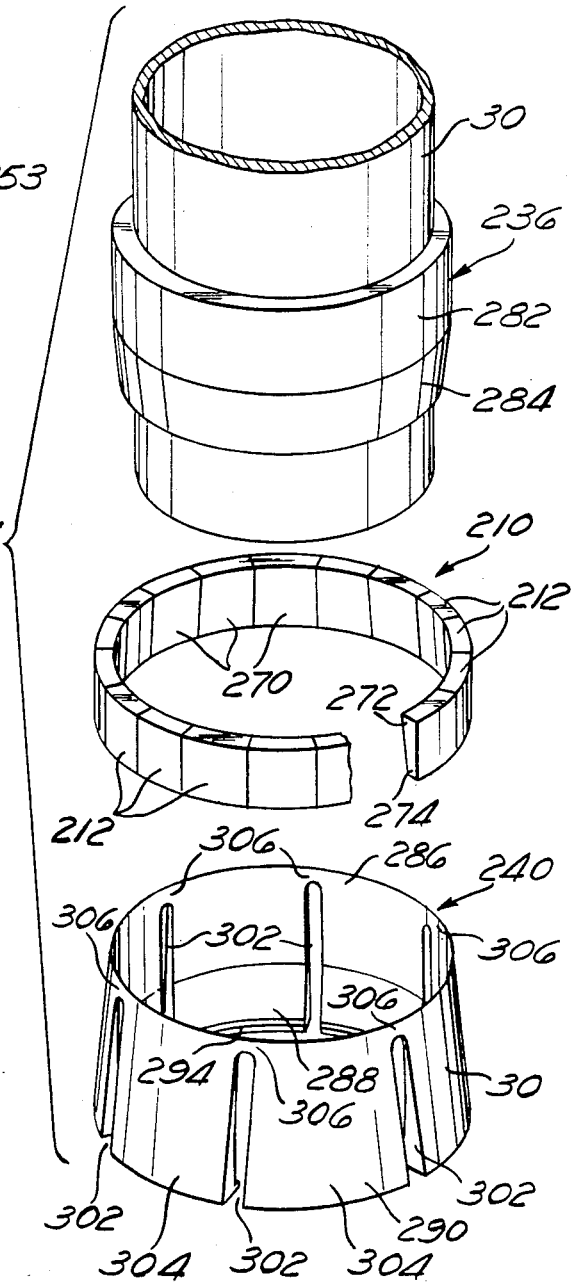
FIG. 15 is an exploded partial perspective view of the actuating cylinder, ramped cylinder, and segmented cylinder.

In an alternative, presently preferred embodiment, a seal mechanism 218, shown in FIGS. 13 to 19, may be utilized in place of the seal mechanism 18. Referring particularly to FIGS. 14 and 15, this seal mechanism 218 is structurally similar to the mechanism 18 in that it includes an actuating or support cylinder 236, corresponding to the actuating cylinder 136 (FIG. 7), a wedge-shaped or ramped cylinder 240, which corresponds to the wedge-shaped keys 140 (FIG. 7), and a segmented cylinder 210 which corresponds to the segmented cylinder 110 (FIG. 7). The actuating cylinder 236 and the ramped cylinder 240 are driven vertically upward as a unit in response to a pull up force on the mandrel 30 to drive the segmented cylinder 210 radially outward against a tubular seal element 222 (FIG. 14) to seal the element 222 against the casing wall 14 (FIG. 14). The seal element 222, like the seal element 22, is preferably formed from a non-elastomeric material, such as a malleable metal.

As best seen in FIG. 14, the seal element 222 comprises a tubular casing seal portion 224, an upper portion 226, and a lower portion 228. The upper and lower seal element portions 226, 228 are attached by welding to to the exterior surfaces of the upper and lower cylinders 250, 252, respectively. The upper and lower cylinders 250, 252 are spaced from each other to provide an annular opening 253 which is bridged by the tubular seal element 222. The casing seal portion 224 is disposed in the annular opening 253 between the upper and lower cylinders 250, 252. The lower end of the upper cylinder 250 and the upper end of the lower cylinder 252 each include an L-shaped annular recess or notch to accommodate U-shaped cross section relief hinges 254, 256, respectively, formed in the upper and lower seal element portions 226, 228, respectively. The purpose of these relief hinges 254, 256 is to permit longitudinal, thermal expansion or contraction of the packer relative to the casing seal portion 224 after the seal 218 has been set. As thermal expansion or contraction occurs, the U-shaped cross section hinges 254, 256 open or close to accommodate such expansion or contraction.

Referring back to FIG. 13, the upper end of the upper cylinder 250 is threaded onto an annular spacer ring 260, which is attached to the mandrel 30 by means of a shear pin 262. The ring 260 spaces the cylinder 250 from the mandrel 30 by approximately the same distance that the seal element 222 is spaced from the mandrel, so that there is an annular space 264 between the cylinder 250 and the mandrel 30.

The lower end of the lower cylinder 252 is connected by welding to an annular bellows 266, formed e.g. of metal, such as Inconel TM, available from Huntington Alloys, Huntington, W. Va. The lower end of the bellows is connected by welding to an annular collar 268, which in turn, is attached to the mandrel 30 by a shear weld 271. As an alternative to the shear weld 271, a shear notch (not shown) can be machined into the collar 268. Those skilled in the art will understand that, although a shear weld may be less expensive, a shear notch may be preferable in many applications, since a shear notch can be precisely machined to fail at a more predictable force than a shear weld. The collar 268 radially spaces the bellows 266 and lower cylinder 252 by approximately the same amount as the upper cylinder 250 and seal element 222. Thus, the upper cylinder 250, seal element 222, lower cylinder 252, and bellows 266 combine to form a generally cylindrical structure which is annularly spaced from the mandrel, and connected to the mandrel at the upper end by the ring 260 and at the lower end by the collar 268.

The segmented cylinder 210 is comprised of plural segments 212 (FIG. 15), which are disposed within the annular opening 253 formed by the upper and lower cylinders 250, 252 and which abut the casing seal portion 224 of the seal element 222. The segmented cylinder 210 has a height which is slightly less than that of the opening 253, so that the segments 212 are free to move radially outward, through the annular opening 253 in response to radial force thereon, to drive the casing seal portion 224 of the seal element 222 against the casing wall 14. Each of the segments 212 (FIG. 15) comprising the segmented cylinder 210 is wedge-shaped and includes an inwardly facing ramped surface 270 which slopes downwardly so that the upper portion 272 of the segments 212 is cross sectionally larger than the lower portion 274. The lower portions 274 of the segments 212 are supported by the upper end of the lower cylinder 252.

The actuating cylinder 236 is concentric with the mandrel 30 and is sized to slide thereon. The actuating cylinder 236 includes an annular projection 276, at the top thereof, which projects radially outward. The bottom of this projection 276 bears against the upper portion 272 of the segmented cylinder 210 to support the cylinder 236. The lower end of the actuating cylinder 236 includes an L-shaped annular recess or notch on the interior surface thereof to form a shoulder for bearing against a snap ring 280, mounted in an annular groove on the exterior of the mandrel 30. The length of the actuating cylinder 236 is less than the length of the annular space 264 to permit vertical movement of the cylinder 236 therein. As best seen in FIG. 15, the upper portion 282 of the cylinder 236, in the embodiment shown, is cylindrical, while the lower portion 284 has a slight downward taper such that it is cross sectionally thinner towards the bottom of the portion 284, to yield a conical or wedge-shape in which the outside diameter decreases from top to bottom. However, it will be understood that this cylinder may have other configurations, e.g., conical throughout its length.

The ramped cylinder 240 is disposed between the actuating cylinder 236 and the segmented cylinder 210, as shown in FIGS. 13 and 14. The interior surfaces of this ramped cylinder 240 are contoured to provide an upper portion 286 and a lower portion 288 which conform to the exterior surfaces on the upper portion 282 and lower portion 284, respectively, of the actuating cylinder 236. The exterior surfaces 290 of the cylinder 240 are tapered upwardly so that the outside diameter of the cylinder 240 increases from top to bottom. The cylinder 240 also includes a series of spaced longitudinal slots or openings 302 which extend from the bottom of the cylinder 240 through a distance which is slightly less than the height of the cylinder 240. Thus, the slots 302 divide the cylinder 240 into plural longitudinal portions 304 which are connected at the top of the cylinder by bridge portions 306. The slots 302 are sized to permit the cylinder 240 to collapse radially inwardly, in response to a radial inward force, preferably by an amount which permits the exterior surfaces 290 to be substantially vertical, instead of upwardly tapered. The bridge portions 306 are sized to readily deform in response to such radially inward force, and thus provide hinges which permit the cylinder 240 to collapse, while maintaining connection between the longitudinal portions 304 so as to prevent the portions 304 from skewing and perhaps jamming during vertical movement thereof. It will be understood that the cylinder 240 may be formed in other ways, e.g. as a segmented cylinder comprising longitudinal segments (not shown) having longitudinal spaces therebetween to permit collapse. However, in such case, it is preferable to provide, e.g., spacer keys (not shown) to prevent the longitudinal segments from skewing as the cylinder is driven upwards.

The lower end of the ramped cylinder 240 includes an annular, radially inward projection 294 having an upper surface which bears against the bottom end of the actuating cylinder 236, so that any force applied to the bottom of the ramped cylinder 240 will tend to lift the actuating cylinder 236 with the ramped cylinder 240. The projection 294 is radially spaced from the mandrel 30 by a distance slightly greater than the distance than the snap ring 280 projects from the mandrel 30, so that upward movement of the cylinder 240 is not prevented by the snap ring 280. The bottom of the ramped cylinder 240 is supported by a series of Bellville washers 296, which in turn, are supported by a support ring 298, attached to the mandrel 30 by means of a shear pin 300.

The support ring 298 is disposed just above the collar 268, and spaced therefrom.

The wedge-shaped segments 212 of the segmented cylinder 210 cross sectionally thicken from top to bottom so that its interior surfaces 270 have a taper which conforms to the taper on the exterior surfaces 290 of the conical cylinder 240, thereby permitting the cylinders 236, 240 to wedgingly interact.

Actuating The Seal Mechanism 218

As with the seal mechanism 18, the seal mechanism 218 is actuated by applying a e.g., 25,000 pound pull up force on the mandrel 30. This pull up force is sufficient to cause the shear pin 262 to shear and thereby permits the mandrel 30 to move upward relative to the segmented cylinder 210 and seal 222, as shown in FIG. 16. The collar 268 and support ring 298 move with the mandrel 30, and the bellows 266 compress, as shown in FIG. 16, to accommodate such movement. The upward movement of the support ring 298, which is attached to the mandrel 30 by the shear pin 300, forces the Bellville washers 296 upward, which in turn, drives the ramped cylinder 240 upward. It will be recalled that the projection 294 of the ramped cylinder 240 bears against the bottom of the actuating cylinder 236. This projection 294 causes the actuating cylinder 236 to be carried upward with the ramped cylinder 240, so that these cylinders 236, 240 move upwardly as a unit. Thus, the pull up force drives the mandrel 30, the actuating cylinder 236, and the ramped cylinder 240 upward relative to the segmented cylinder 210.

The actuating cylinder 236 constrains the ramped cylinder 240 from moving inwardly, so that the outer surface 290 of the ramped cylinder 240, and the inner surface 270 of the segmented cylinder 210 wedgingly interact in response to such upward movement to drive the segments 212 of the segmented cylinder 210 radially outward through the opening 253 and against the seal element 222. Note, however, that the segments 212 do not pass completely through the opening 253, to permit subsequent withdrawal of the segments 212 through the opening 253.

Such radial movement of the cylinder 210 drives the casing seal portion 224 firmly against the casing 14 to seal the annulus between the packer and the casing. Further, the upward movement of the mandrel 30 compresses the Bellville washers 296 so that these washers maintain a biasing force against the ramped cylinder 240 to maintain the radial force on the seal element 222. This ensures that the seal will remain set, even if thermal creep occurs due to the thermal expansion or contraction of the packer. In this embodiment, the washers 296 are quite stiff so that they deflect only a small amount upon compression. This advantageously minimizes the length of the bellows 266, since the bellows 266 do not need to accommodate substantial flexure of the washers 296. Note also that the snap ring 280 is spaced downwardly from the L-shaped recess or notch of the actuating cylinder 236 to accommodate the small amount of deflection of the washers 296, so that the snap ring 280 does not drive the cylinder 236 upward and cause relative movement between the cylinders 236, 240. While, the compression of the washers 296 in the preferred embodiment yields only a small amount of deflection, such compression of the washers 296 should nevertheless provide sufficient deflection to maintain a continual biasing force on the cylinder 240 so that the sealing force between the element 224 and casing 14 does not relax in the event of thermal creep of the packer assembly.

Although the above-described movement of the segmented cylinder 210 creates gaps between the individual segments 212, these gaps are sufficiently small in relation to the thickness of the metal seal element, that the seal element 222 bridges the seal setting force against the gaps.

Releasing The Seal 218

As with the seal 18, the seal 218 is released from the well casing 14 by applying a pull up force, e.g. of 30,000 pounds, on the mandrel 30. This causes the shear pin 300, which connects the support ring 298 to the mandrel 30, and the shear weld 271 which connects the collar 268 to the mandrel 30, to shear, as shown in FIG. 17, thereby allowing the mandrel 30 to move upward with respect to the segmented cylinder 210. The shearing of the pin 300 and weld 271 releases the compression load on the washers 296, and permits them to expand. As such expansion occurs, the support ring 298 moves downward into abutment with the collar 268, which may cause the bellows to re-expand slightly.

The upward movement of the mandrel 30 causes the snap ring 280 to engage the actuating cylinder 236 to drive the cylinder 236 upward with respect to both the ramped cylinder 240 and the segmented cylinder 210, to withdraw the cylinder 236 into the annular space 264. When the upper end of the actuating cylinder 236 contacts the bottom of the spacer ring 260, further movement of the mandrel will tend to lift the entire seal mechanism 218 from the well. Since the annular spacer 264 has a height greater than that of the cylinder 236, such upward withdrawal of the actuating cylinder 236 into the annular space 264 will create a void 310 between the ramped cylinder 240 and the mandrel 30, thereby releasing the radial forces on the seal element 222 and providing an annular space for radially inward withdrawal of the ramped cylinder 240, segmented cylinder 210, and seal element 222. At the moment the void or annular space 310 is created, some inward withdrawal of the cylinders 240, 210 will occur due to the release of the radial seal setting forces and concomitant release of compressive elastic energy stored in the cylinder 240. Moreover, those skilled in the art will recognize that, even though the metal seal element 222 may be flexed beyond its elastic limit, there will still be some energy stored in the element 222 which, upon release, will likewise provide a radially inward force to provide such withdrawal. Further withdrawal, however, will occur as a result of radially inward forces caused by interference between the seal element 222 and the casing 14 as the packer is pulled from the well. Such radially inward forces cause the hinges 306 on the ramped cylinder 240 to deform so that the ramped cylinder 240 collapses into the void 310. In addition, the weight of the ramped cylinder 240, Bellville washers 296, and support ring 300 on the collar 268 may cause the bellows 266 to re-expand and permit some downward movement (not shown) of the ramped cylinder 240. Although such downward movement is not necessary to release the seal, this movement may tend to further separate the ramped surfaces 290, 270 of the cylinders 240, 210, respectively, and thus may permit additional inward freedom of movement of the cylinder 210.

The release of the slip system 16 (FIG. 2) is accomplished concomitantly with the release of the seal mechanism 218, in the same manner as described above for the mechanism 18. Thus, the 30,000 pound pull up force and resultant upward movement of the mandrel 30 relative to both the slip system 16 and seal mechanism 218 releases the engagement of both the slips 70 (FIGS. 4 and 5) and seal element 222 and permits the packer to be lifted from the well casing 14.

As shown in FIG. 17, when the packer is lifted from the well casing 14, the seal mechanism 218 is carried by the snap ring 280 which applies upward force to the support cylinder 236, which in turn bears against the spacer ring 260. The seal element 222 is attached to the spacer ring 262 through the upper cylinder 250, so that when the mandrel 30 is pulled upward, the seal 222 is pulled from its upper end rather than pushed from its lower end. Thus, if the seal element 222 engages any protrusions or irregularities on the casing wall, the element 222 can be freed simply by increasing the pull up force.

As with the seal element 22, the seal element 222 may be formed of a variety of pliant materials which adapt to irregularities in the casing wall, such as plastics, elastomers, and metals. The seal element 222 may also be formed in a variety of configurations which include different shapes and numbers of sealing surfaces. However, for thermal EOR operations, the seal element 222 is preferably of a metal material, capable of withstanding the high temperature, high pressure environments associated with thermal EOR.

In the oil and gas industry, it is common to pressure test the casing packer after setting the seal, but prior to actual use, to insure that there are no leaks at the sealing interface between the seal element 222 and casing 14. This is typically accomplished by pressurizing the upper portion of the well between the seal element 222 and the well head, and monitoring the pressure to detect leaks. In the event that such pressure testing is desired in connection with the present invention, the outer cylinder 250 should preferably be sealed to the mandrel 30 to prevent the entrance of fluid into the seal actuation mechanism, and to avoid placing a differential pressure on the inside of the seal element.

Figure 18:
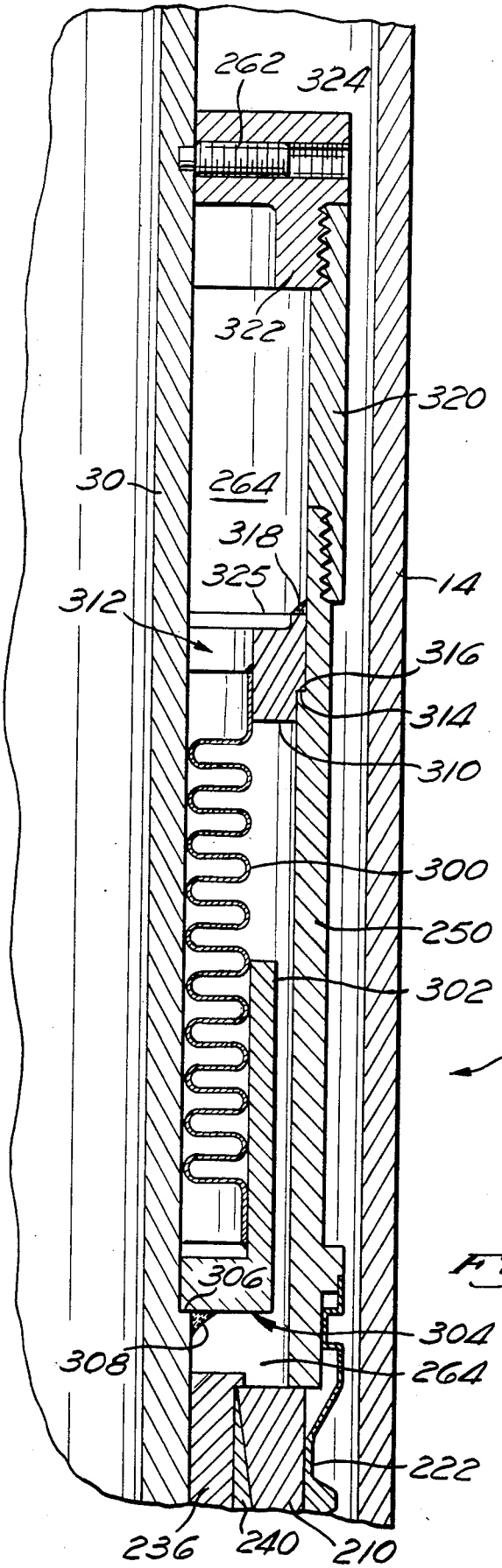
FIG. 18 is a fragmentary elevation view, in cross section, showing a modification of the invention in which an upper bellows is provided to seal between the mandrel and the upper cylinder of the seal mechanism for pressure testing purposes.

Accordingly, the present invention may be modified to include an upper bellows 300, shown in FIG. 18, to provide such seal between the upper cylinder 250 and mandrel 30. The lower end of the bellows 300 is attached, such as by welding, to an upwardly projecting portion 302 of an annular collar 304, which is supported by a lip 306 on the mandrel 30, and permanently attached to the mandrel 30 by a weld 308. The upper end of the bellows 300 is attached, such as by welding, to a lower projecting portion 310 of an upper annular collar 312, disposed within the annular gap 264. The outer surface of the collar 312 is in sliding contact with the inner surface of the upper cylinder 250, and the inner surface of the collar 312 is spaced from the mandrel 30 so as to slidingly mount the collar 312 for upward movement within the gap 264. The lower projecting portion 310 of the collar 312 includes a notch 314 which is positioned and sized to bear against the lip 316 on the upper cylinder 250. This lip 316 supports the collar 312 on the upper cylinder 250 and prevents downward movement thereof. The upper surface of the collar 312 is attached to the upper cylinder 250 by a shear weld 318.

The upper end of the upper cylinder 250 is threaded onto the lower end of an access cylinder 320. The upper end of the access cylinder is threaded onto a lower projecting portion 322 of a spacer ring 324, which is connected to the mandrel by the shear pin 262. The spacer ring 324 is structurally similar, and performs the same function as the spacer ring 260 (FIGS. 13, 16, and 17). The principal difference between the spacer ring 324 and spacer 260 is that the spacer ring 324 is connected to the upper cylinder 250 through the access cylinder 320, while the spacer ring 260 is connected directly to the upper cylinder 250. The purpose of the access cylinder 320 is to provide access to the upper surface 325 of the collar 312 for the purpose of making the shear weld 318. The inner surface of the access cylinder 320 should be flush with the inner surface of the upper cylinder 250, so that the collar 312 may slide freely upwardly through the length of the annular space 264, i.e. from the upper cylinder 250 onto the access cylinder 320.

From the foregoing, it may be seen that the shear weld 318, collar 312, bellows 300, collar 304, and weld 308 effectively seal the annular gap 264 between the upper cylinder 250 and the mandrel 30.

The operation of the invention with the upper bellows 300 in FIG. 18 is the same as that described for the invention without the upper bellows 300 in FIGS. 13, 16, and 17. Referring to FIG. 18, when the seal is set by driving the mandrel 30 upwards, the upward movement of the mandrel will be accommodated by a collapsing (not shown) of the bellows 300. The length of the bellows 300 should be selected such that the upward movement of the mandrel drives the collar 304 to a point somewhat below the collar 312 so as not to break the shear weld 318. Thus, although the bellows will be collapsed when the seal is set, the bellows 300, collars 304, 312, and welds 308, 318 will still seal the annular gap 264 between the upper cylinder 250 and mandrel 30 for pressure testing.

Figure 19:
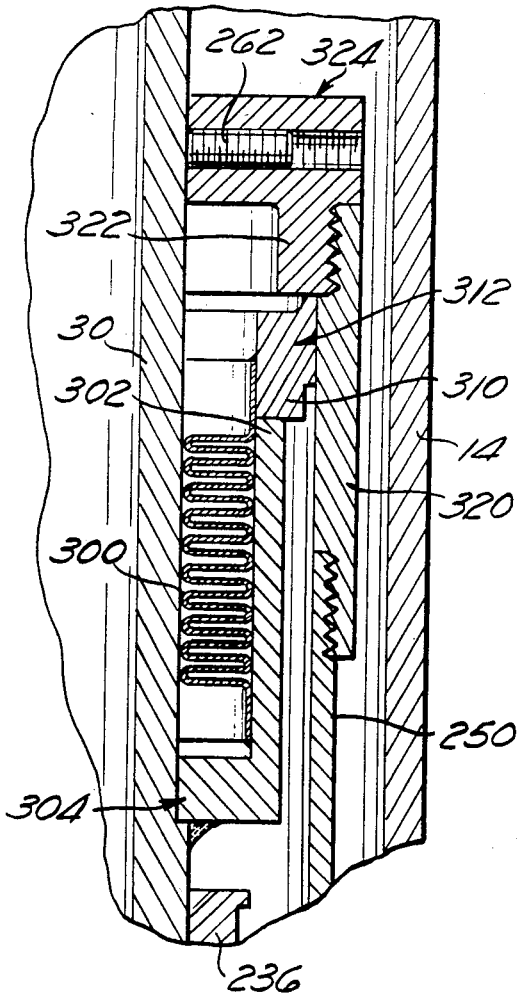
FIG. 19 is a fragmentary elevation view of the modification illustrated in FIG. 18, showing the upper bellows in collapsed condition, as a result of upward movement by the mandrel to release the seal mechanism.

When the seal is released, the additional upward movement of the mandrel 30 will cause the lower collar 304 to be driven against the portion 310 of the upper collar 312 so as to break the shear weld 318, and thereby allow the collar 312 to move upwardly with the lower collar 304 and bellows 300 until it reaches the portion 322 of the spacer ring 324, as shown in FIG. 19. Further upward movement of the mandrel 30 will cause the entire seal mechanism 218 to be lifted from the well as discussed previously in reference to FIG. 17. Thus, the operation of the casing packer with the upper bellows 300 is virtually the same as without the bellows 300.

What is claimed is:

1. A casing packer for sealing the annulus between a well casing and a tube extending therein by direct application of radial force to a seal element, said casing packer comprising:

a tubular mandrel;

means, mounted on said mandrel, for engaging said casing to lock said mandrel in place at said location; and means, mounted on said mandrel, for sealing the annulus between said mandrel and said casing, comprising:

a seal element formed of permanently deformable, non-elastomeric material;

first and second wedges;

means for driving said first wedge axially to drive said second wedge radially outward and thereby drive said seal element radially outward beyond the elastic limit of said seal element, to permanently deform said seal element against said casing by direct application of radial force to said seal element; and means for withdrawing said first wedge radially inward to permit said seal element to deform inwardly in response to interference between said seal element and said well casing during removal of said casing packer from said well casing.

2. A casing packer, as defined in claim 1, wherein said seal element driving means is actuated in response to a pull-up force on said tube of a first predetermined magnitude at the well head.

3. A casing packer, as defined in claim 2, additionally comprising:

means for releasing said seal element driving means in response to a pull-up force of a second predetermined magnitude at the well head.

4. A casing packer, as defined in claim 1, additionally comprising:

means for latching said driving means to maintain said radial force on said seal element.

5. A casing packer, as defined in claim 4, wherein said latching means comprises:

means for biasing said seal element driving means and said mandrel in opposite longitudinal directions; and means for loading said biasing means, comprising:

ratchet means for permitting movement of said mandrel to load said biasing means and for preventing said mandrel from moving to unload said biasing means.

6. A casing packer, as defined in claim 1, wherein said seal element driving means comprises:

a first member, having a first ramped surface, and a second member, having a second ramped surface, said first member being operatively connected to move longitudinally with said mandrel, while said second member is fixed relative to said seal element, said ramped surfaces interacting to drive said seal element radially outward when said mandrel is moved longitudinally relative to said seal element.

7. A casing packer, as defined in claim 1, wherein said driving means comprises a resilient member which cooperates with said mandrel to drive said first wedge axially in response to movement of said mandrel.

8. A casing packer, as defined in claim 1, wherein said means for withdrawing comprises an actuating cylinder, mounted on said mandrel, a member for driving said actuating cylinder, mounted on said mandrel, and a shear member, mounted on said mandrel, for permitting relative movement between said mandrel and said first wedge, said driving member driving said actuating cylinder relative to said first wedge in response to movement of said mandrel so as to permit withdrawal of said first wedge radially inwardly.

9. A casing packer for sealing the annulus between a well casing and a tube extending therein by direct application of radial force to a seal element, said casing packer comprising:

a tubular mandrel;

means, mounted on said mandrel, for engaging said casing to lock said mandrel in place at said location; and means, mounted on said mandrel, for sealing the annulus between said mandrel and said casing, comprising:

a tubular seal element;

means for driving said seal element radially outward against said casing by direct application of radial force to said seal element, comprising:

plural first members, each having a first ramped surface;

plural second members, each having a second ramped surface, said plural second members comprising respective plural longitudinal segments forming a segmented cylinder;

an actuating cylinder, concentric with said segmented cylinder, which concentrically surrounds said mandrel and engages said plural first members; and said first members being operatively connected to move longitudinally with said mandrel, while said second members are fixed relative to said seal element, said ramped surfaces interacting to drive said seal element radially outward when said mandrel is moved longitudinally relative to said seal element, the center of said plural segments being driven radially outward in response to said interaction of said ramped surfaces, said center of said plural segments driving said seal element radially outward.

10. A casing packer, as defined in claim 9, wherein said first members comprise respective ramped keys, said first surfaces comprise the inclined surfaces of said ramped keys, and said second surfaces comprise the inclined surfaces of ramped keyways in said plural segments, respectively, of said segmented cylinder.

11. A casing packer, as defined in claim 10, additionally comprising:

means for constraining the ends of said plural segments to force said segments to bow when said center of said plural segments is driven radially outward.

12. A casing packer, as defined in claim 11, wherein said plural segments are resilient.

13. A casing packer, as defined in claim 12, additionally comprising:

means for releasing said seal element driving means by applying a pull-up force at the well head.

14. A casing packer, as defined in claim 13, wherein said releasing means comprises:

means for connecting said mandrel to said actuating cylinder, said pull-up force disconnecting said connecting means to permit said mandrel to move relative to said actuating cylinder, said actuating cylinder having respective slots which engage said ramped keys, said mandrel having pockets, longitudinally aligned with said slots and sized to receive said keys, said pull-up force positioning said pockets adjacent to said slots to permit said resilient segments to drive said keys radially inward into said pockets to remove said outward radial driving force of said segments on said seal element.

15. A casing packer, as defined in claim 14, wherein said connecting means comprises a shear pin.

16. A casing packer for sealing the annulus between a well casing and a tube extending therein by applying, at the well head, longitudinal forces on said casing packer, comprising:

a tubular mandrel;

means, operably connected to said mandrel, for locking said casing packer in place at a location within said well casing in response to a first longitudinal force on said mandrel;

means, operably connected to said mandrel, for sealing the annulus between said mandrel and said casing in response to a second longitudinal force on said mandrel, said sealing means comprising:

a tubular seal element; and means for driving said seal element against said casing in response to said second longitudinal force on said mandrel; and means for latching said driving means to maintain said seal element against said casing if said second longitudinal force on said mandrel is released, said latching means comprising:

a first resilient member, separate from said seal element, compressed by said second longitudinal force; and means for maintaining said first resilient member in compression if said second longitudinal force is released.

17. A casing packer, as defined in claim 16, additionally comprising:

a second resilient member, separate from said seal element, compressed by said first longitudinal force, said maintaining means also maintaining said second resilient member in compression if said first longitudinal force is released.

18. A casing packer, as defined in claim 17, wherein said first and second resilient members each comprise a spring washer.

19. A casing packer for sealing the annulus between a well casing and a tube extending therein, comprising:

a tubular mandrel; and means, mounted on said mandrel, for sealing the annulus between said mandrel and said casing comprising:

a metal seal element having a casing seal portion for providing an interface with said well casing to seal said annulus; and mechanical means for driving said seal element radially outward against said casing by direct mechanical application of radial force, to drive said casing seal portion against said well casing to provide said interface, said metal seal element flexed beyond its elastic limit when driven against said casing by said mechanical driving means;

means for creating a void behind said seal element, said void through the entire length of said interface to allow said seal element to deform inwardly to permit removal of said casing packer from said well casing, said sealing means mounted on said mandrel such that when a lifting force is applied to said casing packer, said lifting force is transferred to said seal element at a location above said casing seal portion to permit said seal element to be pulled, rather than pushed, from said well casing, thereby reducing jamming of said seal element with said well casing.

20. A casing packer, as defined in claim 19, wherein said sealing means additionally comprises:

releasable means for constraining said mechanical driving means to move longitudinally with said mandrel, said void creating means comprising means for releasing said constraining means.

21. A casing packer, as defined in claim 19, wherein said seal element is formed of brass.

22. The casing packer, as defined in claim 19, wherein said mechanical means for driving said seal element radially outward comprises an actuating cylinder, a ramped cylinder, and a segmented cylinder, said ramped cylinder and said segmented cylinder having ramped surfaces which wedgingly interact in response to movement of said mandrel to drive said seal element radially outward, and said means for creating a void behind said seal element comprising a member, mounted on said mandrel, for driving said actuating cylinder relative to said ramped cylinder to provide said void behind said seal element.

23. A well casing packer for sealing the annulus between a well casing and a tube extending therein by direct application of radial force to a seal element, said casing packer comprising:

a tubular mandrel;

a slip system, mounted on said mandrel, which engages the well casing to lock the packer firmly in place at the desired depth; and a seal mechanism, mounted on said mandrel, comprising:

an inner actuating wedge;

an outer seal element;

an intermediate segmented cylinder, disposed between said wedge and said seal element, having an inclined surface adjacent to said wedge;

means for constraining said wedge from moving inwardly in response to longitudinal movement of said mandrel, said wedge interacting with said inclined surface in response to longitudinal movement of said wedge to drive said segmented cylinder radially outward against said seal element, and thus drive said seal element radially outward against said well casing; and means for releasing said constraining means to permit said wedge to move inwardly in response to longitudinal movement of said mandrel to allow removal of said casing packer from said casing.

24. A well casing packer, as defined by claim 23, wherein said means for constraining said wedge from moving inwardly comprises an actuating cylinder, between said wedge and said mandrel, and wherein said means for releasing said constraining means comprises a member, mounted on said mandrel, for driving said actuating cylinder relative to said wedge so as to permit inward movement of said wedge.

25. A well casing packer for sealing the annulus between a well casing and a tube extending therein by direct application of radial force to a seal element, said casing packer comprising:

a tubular mandrel;

a slip system, mounted on said mandrel, which engages the well casing to lock the packer firmly in place at the desired depth; and a sealing mechanism, mounted on said mandrel, comprising:

an inner actuating wedge, comprising plural keys which are interconnected by an inner cylinder;

an outer cylindrical seal element;

an intermediate segmented cylinder, disposed between said wedge and said seal element, having an inclined surface adjacent to said wedge, said segmented cylinder including a keyway which forms said inclined surface of said segmented cylinder; and means for operably connecting said wedge to said mandrel to permit said wedge to move longitudinally in response to longitudinal movement of said mandrel, said wedge interacting with said inclined surface in response to longitudinal movement of said wedge to drive said segmented cylinder radially outward against said seal element, and thus drive said seal element radially outward against said well casing.

26. A method for recovering oil, using high temperature fluids in excess of 575° F., in which the annulus between a well casing and a tube extending therein is sealed to prevent passage of said high temperature fluids through said annulus, said tube having a concentric, non-elastomeric seal element mounted thereon, said method comprising:

driving said non-elastomeric seal element radially outward against said well casing by direct application of radial force thereto, to provide an interface with said casing which seals said annulus to prevent the passage of said high temperature fluid therethrough, said radial force sufficient to permanently deform said seal element;

conducting said high temperature fluid in excess of 575° F. through said tube, said fluid heating the geologic formation surrounding the well to free oil in said formation, said non-elastomeric material capable of withstanding said temperature in excess of 575° F.;

creating a void behind said seal element throughout the entire length of said interface to permit radially inward deflection of said permanently deformed seal element throughout the entire length of said interface; and removing said seal element from said well casing by applying a pulling force to said metal seal element at a location above said interface.

27. A method for sealing the annulus between a well casing and a tube extending therein as defined in claim 26, wherein said radial force is sufficient to provide a friction interface between said seal and said casing capable of locking said seal and tube in position against the force applied to said seal by said fluid.

28. A method for recovering oil, as defined by claim 26, wherein said driving step comprises the step of relatively sliding a pair of wedges, and said step of creating a void behind the seal element comprises the step of removing support for one of said wedges to permit said seal element to deflect radially inwardly.

29. A method for sealing the annulus between a well casing and a tube extending therein, said tube having an inner cylinder, an outer cylinder, and a seal element mounted thereon, said inner cylinder constrained to move with said tube, and interacting with said outer cylinder to drive said outer cylinder outward, against said seal element, in response to a force on said tube, said method comprising:

applying a force on said tube to cause said inner cylinder to drive said outer cylinder radially outward against said seal element, and thereby drive said seal element against said casing by direct application of radial force;

releasing said force on said tube;

biasing said inner cylinder relative to said outer cylinder when said force on said tube is released to maintain the radial force on said seal element, so that said seal element prevents passage of fluid through said annulus; and releasing said seal element from its engagement with said casing by applying a pull-up force on said tube sufficient to break said constraint of said tube with said inner cylinder.

30. A method for sealing the annulus between a well casing and a tube extending therein, as defined by claim 29, wherein said constraint of said tube with said inner cylinder comprises a shear member and a resilient member, and wherein the biasing step additionally comprises compressing said resilient member and the releasing step additionally comprises releasing the compression on said resilient member.

31. A casing packer for sealing the annulus between a well casing and a tube extending therein by direct application of radial force to a seal element, said casing packer comprising:

a tubular mandrel;

means, mounted on said mandrel, for sealing the annulus between said mandrel and said casing, comprising:

a seal element;

means for driving said seal element against said casing by direct application of radial force, comprising:

a first member, fixed relative to said seal element, for applying radial force to said seal element;

a second member, constrained to move longitudinally with said mandrel, said first and second members having respective ramped surfaces which interact in response to longitudinal movement of said mandrel to drive said first member radially outward;

a third member, constrained to move with said second member; and means for releasing the constrained between said second member and said third member to release said radial force applied to said seal element.

32. A casing packer, as defined by claim 31, wherein said first member comprises a segment of a segmented cylinder, and said third member comprises an actuating cylinder.

33. A casing packer, as defined by claim 32, wherein said second member comprises one of plural keys and said releasing means comprises one of plural pockets formed in said mandrel.

34. A casing packer, as defined by claim 31, wherein said second member is constrained to move longitudinally with said mandrel through a resilient member and a shear member, and wherein said releasing means comprises said shear member.

35. A casing packer, as defined by claim 31, wherein said first member comprises a segmented cylinder, said second member comprises a ramped cylinder, and said third member comprises an actuating cylinder, the release of said constraint by said means for releasing allowing said actuating cylinder to be driven longitudinally relative to said ramped cylinder to release said radial force.

36. A method for selectively sealing the annulus between a well casing and a tube, extending longitudinally therein, said tube having (1) a seal element, and (2) first and second wedging members for driving said seal element, mounted thereon, said method comprising:

relatively, longitudinally sliding said first and second wedging members to cause respective surfaces on said members to interact to drive said first member radially outward, against said seal element; and releasing the force on said seal element by moving said second member radially inward, towards said mandrel.

37. A method for selectively sealing the annulus between a well casing and a tube, as defined by claim 36, wherein said releasing step additionally comprises the step of removing a third member from between said tube and said seal element to permit said second member to move radially inwardly, towards said mandrel.

38. A method for selectively sealing the annulus between a well casing and a tube, extending longitudinally therein, said tube having (1) a seal element, and (2) first and second wedging members for driving said seal element, mounted thereon, said method comprising:

relatively, longitudinally forcing said first and second wedging members in a first direction to cause respective surfaces on said members to slidingly interact to drive said first member radially outward, against said seal element; and releasing the force on said seal element by increasing said relative, longitudinal forcing in said first direction.

39. A method for selectively sealing the annulus between the well casing and a tube, as defined by claim 38, wherein said releasing step additionally comprises the step of withdrawing a third member from between said seal element and said tube to permit inward movement of said seal element.

40. In a well casing packer, a seal mechanism mounted on a mandrel, said seal mechanism comprising:

a seal element;

a wedge member (a) for driving said seal element radially outward against a well casing by applying radial forces to said seal element, and (b) for supporting said seal element to maintain said radial forces;

a support member for supporting said wedge member and said seal element to maintain said radial forces on said seal element, said support member and said wedge member constrained to move together in the same longitudinal direction during said driving of said seal element; and means for releasing said radial forces on said seal element, comprising:

means for driving one of said members longitudinally relative to the other of said members to remove the support on said seal element by said other of said members.

41. In a well casing packer, a seal mechanism, as defined by claim 40, wherein said support member comprises a tubular mandrel.

42. In a well casing packer, a seal mechanism, as defined by claim 41, additionally comprising an actuating cylinder, between said mandrel and said wedge member, and a member for driving said actuating cylinder longitudinally relative to said wedge member in response to longitudinal movement of said mandrel.

43. In a well casing packer, a seal mechanism, as defined by claim 41 additionally comprising a resilient member for driving said wedge member relative to said seal element, in response to longitudinal movement of said mandrel, to drive said seal element radially outward.

44. In a well casing packer, a seal mechanism, as defined by claim 43, wherein said resilient member biases said wedge member and said mandrel in opposite directions.

45. In a well casing packer, a seal mechanism, as defined by claim 43, wherein said releasing mechanism additionally comprises a member, releasably mounted on said mandrel, for supporting said resilient member.

46. In a well casing packer, a seal mechanism, as defined by claim 41, additionally comprising upper and lower cylinders for mounting said seal element to said mandrel, one of said cylinders mounted to said mandrel through a compressible bellows, said compressible bellows accommodating relative movement between said mandrel and said one of said cylinders during driving by said driving means.

47. In a well casing packer, a seal mechanism, as defined by claim 41, wherein said seal element includes a hinge for accommodating relative movement between said seal element and said mandrel due to thermal expansion and contraction of said casing packer.

48. In a well casing packer, a seal mechanism, as defined by claim 41, additionally comprising a sealing member, for sealing between said seal element and said mandrel, to prevent passage of fluid therebetween.

49. In a well casing packer, a seal mechanism, as defined by claim 51, wherein said sealing member comprises a compressible bellows.

50. In a well casing packer, a seal mechanism, as defined by claim 40, wherein said driving means comprises an actuating cylinder.

51. In a well casing packer, a seal mechanism, as defined by claim 40, additionally comprising a segmented cylinder, having plural segments, disposed between said wedge member and said seal element, said segmented cylinder having longitudinal gaps between said segments during said driving of said seal element, said seal element having sufficient strength to bridge said radial forces across said longitudinal gaps.

52. In a well casing packer, a seal mechanism, as defined by claim 40, wherein said seal element is formed on a non-elastomeric material, and is driven beyond its elastic limit by said radial forces, said releasing mechanism creating a void interior to said seal element upon release of said radial forces to permit said seal element to deform inwardly.

53. A method of sealing the annulus between a well casing and a tube extending therein, said tube having a seal element mounted thereon, said method comprising:

driving said seal element radially outward by direct application of radial force to said seal element, utilizing a wedge member and a support member;

constraining said wedge member and said support member to move together during said driving step;

supporting said seal element utilizing said wedge member and said support member to maintain said radial forces on said seal element; and driving one of said members longitudinally relative to the other of said members to remove the support on said seal element by said other of said members, and thereby release said radial forces.

54. A method of sealing the annulus between a well casing and a tube extending therein, as defined by claim 53, wherein said wedge member comprises a ramped cylinder.

55. A method of selectively sealing the annulus between a well casing and a tube extending therein, as defined by claim 53, wherein said wedge member, and said seal element comprise a seal mechanism, said method additionally comprising:

removing said seal mechanism from said casing by applying an upward force to said seal mechanism at a location which is above the seal element to reduce any jamming of said seal element against said casing.

56. A method of selectively sealing the annulus between a well casing and a tube extending therein, as defined in claim 53, wherein said seal element is formed of a non-elastomeric material, said method additionally comprising:

creating a void interior to said seal element to permit said non-elastomeric seal element to deform radially inwardly during removal of said tube from said well casing.

57. A method of sealing the annulus between a well casing and a tube extending therein, as defined in claim 53, additionally comprising:

sealing between said tube and said seal element to prevent passage of fluid therebetween.

58. In a casing packer for sealing the annulus between a well casing and a tubular mandrel, a seal mechanism, comprising:

a seal element;

a wedge;

means for driving said wedge axially to drive said seal element radially outward against said casing by direct application of radial force; and releasing means for providing a cavity interior to said wedge to permit inward movement of said wedge and to release said radial force on said seal element.

59. In a casing packer for sealing the annulus between a well casing and tubular mandrel, a seal mechanism, as defined by claim 58, wherein said releasing means comprises an actuating cylinder, and a member mounted on said mandrel, for driving said actuating cylinder relative to said wedge.

* * * * *